US007061456B2

(12) United States Patent
Hiyama et al.

(10) Patent No.: US 7,061,456 B2
(45) Date of Patent: Jun. 13, 2006

(54) IMAGE DISPLAY METHOD AND IMAGE DISPLAY APPARATUS

(75) Inventors: Ikuo Hiyama, Hitachi (JP); Shinichi Komura, Hitachi (JP); Tsunenori Yamamoto, Hitachi (JP); Tetsuya Aoyama, Hitachi (JP); Hideo Sato, Hitachi (JP); Makato Tsumura, Hitachi (JP); Katsumi Kondo, Mito (JP); Yuka Utsumi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 207 days.

(21) Appl. No.: 09/829,078

(22) Filed: Apr. 10, 2001

(65) Prior Publication Data

US 2002/0051153 A1 May 2, 2002

(30) Foreign Application Priority Data

Jun. 8, 2000 (JP) ..... 2000-172192

(51) Int. Cl.
*G09G 3/36* (2006.01)

(52) U.S. Cl. ..... 345/87; 345/98; 345/630; 345/635; 345/698

(58) Field of Classification Search ..... 345/87–104, 345/630, 635, 638
See application file for complete search history.

(56) References Cited

U.S. PATENT DOCUMENTS

| | | | | |
|---|---|---|---|---|
| 4,328,490 | A * | 5/1982 | Usuba et al. | 345/618 |
| 5,543,845 | A * | 8/1996 | Asamura et al. | 375/240.02 |
| 5,721,597 | A * | 2/1998 | Kakinuma et al. | 349/86 |
| 5,952,991 | A * | 9/1999 | Akiyama | 345/98 |
| 6,088,012 | A * | 7/2000 | Shigeta et al. | 345/63 |
| 6,104,463 | A * | 8/2000 | Shibahara | 349/141 |
| 6,160,593 | A * | 12/2000 | Nakakuki | 348/713 |
| 6,297,787 | B1 * | 10/2001 | Nishida | 345/1.3 |
| 6,329,973 | B1 * | 12/2001 | Akimoto et al. | 345/98 |
| 6,339,446 | B1 * | 1/2002 | Miyoshi | 348/65 |

FOREIGN PATENT DOCUMENTS

JP WO97/11447 * 3/1997

* cited by examiner

*Primary Examiner*—Dennis-Doon Chow
(74) *Attorney, Agent, or Firm*—Antonelli, Terry, Stout and Kraus, LLP.

(57) ABSTRACT

A display method can achieve both a substantially high definition image display and high speed dynamic image display. The image displaying method of an image displaying apparatus having a display portion consisting of a plurality of pixels takes each of a predetermined number of pixels as one block unit and forms one screen image for display by combining a region for displaying the same information on a plurality of pixels in one block unit during one scanning period and a region for permitting display of respectively different information on the plurality of pixels in the one block unit.

12 Claims, 24 Drawing Sheets

IMAGE DISPLAY METHOD AND IMAGE DISPLAY APPARATUS

BACKGROUND OF THE INVENTION

The present invention relates to an image display apparatus. More particularly, the invention relates to means for arbitrarily switching display resolution and rewriting speed of an image within a display screen.

In recent years, progress has been made in the reduction of the thickness and weight of an image display apparatus. In place of the CRT which has been primarily used as an image display device, a flat panel display, such as a liquid crystal display, PDP (Plasma Display Panel), and ELD (Electroluminescent Display) has experienced widespread use. On the other hand, the development of new technology, such as the design of a FED (Field Emission Display) and so forth, has also received much attention. Furthermore, as a result of the widespread use of the personal computer, DVD, digital broadcasting and so forth, the provision of a display having a high definition and high gradation or multi-level gradation has becomes essential. The demand for higher performance, particularly a higher definition level of the image display apparatus, is expected to be grow in the future.

However, in a current display method for display of an image or a current driving system for use in an image display apparatus, it is becoming difficult to cope with the increase in the display frequency associated with the increased density of the display due to signal delay on the line, lack of a sufficient writing period to respective pixels and an increase in the scanning frequency.

On the other hand, degradation of the image quality when a dynamic image is displayed in a hold illumination type image display apparatus, such as liquid crystal display, has been reported in Institute of Telecommunications Engineers Technical Report EID 96-4, pp. 19–26 (June, 1996). According to this report, due to mismatching of a dynamic image in hold illumination and the radial motion of the human eye when following a dynamic image, bluing of the dynamic image can be caused so as to lower the image quality of the dynamic image display. In order to avoid such lowering of image quality of the dynamic image display, a method of multiplying a frame frequency by n times and other methods have been disclosed.

A method of multiplying the frame frequency by n times, for clearly displaying a dynamic image on a hold illumination type image display apparatus, such as a liquid crystal display, is a method of increasing the display frequency. However, as set forth above, in the current method of display of an image or the driving system used in the image display apparatus, the increasing of the display frequency is becoming close to the limit.

In the future, in order to adapt to increases in high density display and dynamic image display, a study has been made for a new material for a dynamic display and for reducing the line resistance and line capacity as a factor for signal delay on the line.

On the other hand, in order to improve the writing capacity for a pixel, a thin film transistor (TFT) using polycrystalline silicon has been recently commercialized as a replacement of the conventional TFT using amorphous silicon.

Furthermore, Japanese Patent Application Laid-open No. 8-006526 (1996) discloses a liquid crystal image display apparatus using means for switching between single line selection and multiple line simultaneous selection for varying the resolution.

However, in this technology, the resolution is constant on the line. Furthermore, nothing has been mentioned in connection with a method capable of achieving both high definition and high speed display.

Furthermore, Japanese Patent Application Laid-Open No. 9-329807 (1997) discloses a liquid crystal image display apparatus which has block selection means for lowering the power consumption and rewriting only a rewritten image per block. However, for dynamic image display, in which the entire screen image is rewritten, a high speed dynamic image display is difficult due to signal delay and a limitation on the writing performance.

In order to reduce signal delay on the line and enhance the writing performance, it is essential to develop a material and/or a process which will produce such benefits. However, there are lots of problems to be solved, such as reliability, stability, uniformity and so forth. Therefore, it is estimated that it will require a long development period to obtain a satisfactory product.

Therefore, a displaying method or driving method capable of high definition display and dynamic image display with increased demand, must be developed using currently available material and an active element, such as TFT, MIM and so forth.

According to a study of human visual characteristics, for dynamic image display, sufficient image quality can be perceived even with not so high a definition, since the image is rewritten at high speed. On the other hand, for still image display, while it is not necessary to rewrite the image at high speed, for perception of sufficient image quality, a high definition display is required.

SUMMARY OF THE INVENTION

It is a first object of the present invention to provide a display method which can achieve both a substantially high definition image display and high speed dynamic image display by eliminating information of lower recognition level utilizing visual characteristics for still image display and dynamic image display.

It is a second object of the present invention to provide an image display apparatus which is capable of arbitrarily switching between a region for lowering definition of a dynamic image and displaying with rewriting at high speed, and a region of high definition display of a still image when rewriting at low speed.

it is a third object of the present invention to provide an image display system constructed with image generating means, display control means, information storage means, and dynamic image/still image judgment means for achieving both a high definition display and a high speed dynamic image display.

According to one aspect of the invention, an image displaying method of an image displaying apparatus having a display portion consisting of a plurality of pixels comprises the steps of: taking each of a predetermined number of pixels as one block unit; forming one screen image for display by combining a region for displaying the same information on a plurality of pixels in the one block unit during one scanning period and a region for permitting display of respectively different information on the plurality of pixels in the one block unit.

According to a second aspect of the present invention, an image displaying method of an image displaying apparatus having a display portion consisting of a plurality of pixels comprises the steps of: taking each of a predetermined number of pixels as one block unit; discriminating an image to be displayed in each block unit between a dynamic image and a still image; forming one screen image for display by combining a region for displaying the same information on a plurality of pixels in the one block unit during one scanning period and a region for permitting display of respectively different information on the plurality of pixels in the one block unit.

In the preferred construction, the respective regions can be switched into regions having an arbitrary size greater than or equal to the one block unit.

The image display method may further comprise the steps of discriminating a definition level of the still image per one block unit; and displaying the same information in an arbitrarily number of a plurality of pixels in the one block unit for a still image of low definition level.

The one screen image may consist of frames in a number less than or equal to the number of the plurality pixels forming one block unit, and the plurality of pixels may be selected per frame.

The image display method may comprise arranging a plurality of scanning lines and a plurality of signal lines of the image displaying apparatus in matrix fashion; forming switches connected to intersections of the scanning lines and the signal lines whereby they are connected to a plurality of scanning lines and a plurality of signal lines; dividing opposed electrodes opposing the pixel electrodes connected to the switches per a plurality of pixels; and applying driving waveforms at different levels to the signal lines and the opposed electrodes depending upon a region for displaying the same information and a region for permitting display of different information.

The image display apparatus is a display device which has a lighting device on a back surface, a pair of transparent substrates having a polarizing panel and a liquid crystal layer disposed between the pair of transparent substrates for applying an electrical field to the liquid crystal layer for controlling the orienting condition of the liquid crystal layer for displaying the image, blinking illumination of the lighting device being provided in synchronism with the scanning when the region for displaying the same information on a plurality of pixels in one block unit during one scanning period.

According to a third aspect of the present invention, an image displaying method fox an image display system including an image displaying apparatus, an image generating device for generating an image signal to be displayed on the image display apparatus, a display control device for controlling the image display apparatus on the basis of the image signal and an information storage device for holding information corresponding to the image signal, comprises the step of discriminating a region for displaying the same information and a region for displaying different information by the image display apparatus.

According to a fourth aspect of the present invention, an image displaying method for an image display system including an image displaying apparatus, an image generating device for generating an image signal to be displayed on the image display apparatus, a display control device for controlling the image display apparatus on the basis of the image signal and an information storage device for holding information corresponding to the image signal, comprises the step of discriminating a region for displaying the same information and a region for displaying different information by the display control device.

According to a fifth aspect of the present invention, an image displaying method for an image display system including an image displaying apparatus, an image generating device for generating an image signal to be displayed on the image display apparatus, a display control device for controlling the image display apparatus on the basis of the image signal and an information storage device for holding information corresponding to the image signal, comprises the step of discriminating a region for displaying the same information and a region for displaying different information by the image generating device.

According to a sixth aspect of the present invention, an image display apparatus having a display controller for converting image data into a display data, an image converting circuit and a display panel, further comprises a frame memory feeding data having different resolutions on the display panel and a dynamic image/still image discriminating circuit; the display panel including a signal driver applying an image data signal to a signal line, a control signal driver applying a scanning signal to a scanning line and a pixel selection driver for applying a display block selection signal to a selection signal line, the display panel taking a predetermined number of pixels among a plurality of pixels arranged in matrix fashion as one block unit, and one screen image for displaying is formed by combining a region for displaying the same information on a plurality of pixels in the one block unit during one scanning period and a region for permitting display of respectively different information on the plurality of pixels in the one block unit.

According to a seventh aspect of the present invention, an image display apparatus having a display controller for converting image data into a display data, an image converting circuit and a display panel, comprises a frame memory feeding data having different resolutions on the display panel and a dynamic image/still image discriminating circuit; the display panel including a signal driver applying an image data signal to a signal line, a control signal driver applying a scanning signal to a scanning line and a pixel selection driver for applying a display block selection signal to a selection signal line, the display panel taking a predetermined number of pixels among a plurality of pixels arranged in matrix fashion as one block unit, and one screen image for displaying is formed by combining a dynamic image region for displaying the same information on a plurality of pixels in the one block unit during one scanning period and a still image region for permitting display of respectively different information on the plurality of pixels in the one block unit, the dynamic image region is displayed on the basis of dynamic image data from the dynamic image/still image discriminating circuit, and the still image region is displayed on the basis of the still image data from the frame memory.

The image displaying apparatus may comprise a lighting device provided on a back surface; a pair of transparent substrates having a polarizing panel; a liquid crystal layer disposed between the pair of transparent substrates; one of the pair of transparent substrates having a plurality of scanning lines, a first signal line and a second signal line formed with a plurality of the scanning lines in the form of a matrix, a plurality of first switches formed corresponding to intersections of the plurality of the scanning lines and a plurality of the first signal lines, a plurality of second switches formed between a plurality of the second signal lines and a plurality of the first switches, one of the pair of transparent substrates having an opposed electrode, an electric field being applied between the pixel electrodes and the opposed electrode, and an image being displayed by controlling the orienting condition of the liquid crystal.

The display panel may have a pixel electrode and an opposed electrode for applying a lateral electric field to the pixel portion of the pixel and the opposed electrode.

The display panel may have a pixel electrode on one of the transparent substrates and the opposed electrode on the other transparent substrate in order to apply a vertical electric field to pixel portion of the pixel.

A color filter mounted on the pixel portion of the pixel may have a stripe structure parallel to the scanning line.

The lighting device may have lighting control means for moving a light emitting region in synchronism with a scanning signal applied to the scanning line.

The image displaying apparatus may comprise a lighting device provided on a back surface; a pair of transparent substrates having a polarizing panel; a liquid crystal layer disposed between the pair of transparent substrates; one of the pair of transparent substrates having a plurality of scanning lines, a first signal line and a second signal line formed with a plurality of the scanning lines in the form of a matrix, a plurality of first switches formed corresponding to intersections of the plurality of the scanning lines and a plurality of the first signal lines, a plurality of second switches formed between a plurality of the second signal lines and a plurality of the first switches, a pixel electrode connected to a plurality of the first switches or a plurality of the second switches, an opposed electrode connected to a plurality of the first switches or a plurality of the second switches, an electric field being applied between the pixel electrodes and the opposed electrode, and an image being displayed by controlling the orienting condition of the liquid crystal.

The image displaying apparatus may comprise a lighting device provided on a back surface; a pair of transparent substrates having a polarizing panel; a liquid crystal layer disposed between the pair of transparent substrates; one of the pair of transparent substrates having a plurality of scanning lines, a first signal line and a second signal line formed with a plurality of the scanning lines in the form of a matrix, a plurality of first switches formed corresponding to intersections of the plurality of scanning lines and a plurality of first signal lines, a plurality of second switches formed between a plurality of second signal lines and a plurality of the first switches, pixel electrodes connected to a plurality of the second switches, opposed electrodes on one of the pair of transparent substrates, an electric field being applied between the pixel electrodes and the opposed electrode, and an image being displayed by controlling the orienting condition of the liquid crystal.

The display panel may have a pixel electrode and an opposed electrode for applying a lateral electric field to a pixel portion of the pixel. In the alternative, the display panel may have a pixel electrode and an opposed electrode for applying a vertical electric field to a pixel portion of the pixel.

The image displaying apparatus may comprise a fighting device provided on a back surface; a pair of transparent substrates having a polarizing panel; a liquid crystal layer disposed between the pair of transparent substrates; one of the pair of transparent substrates having a plurality of scanning lines, a first signal line and a second signal line formed with a plurality of the scanning lines in the form of a matrix, a plurality of switches formed corresponding to intersections of the plurality of scanning lines and a plurality of the first signal lines, a pixel electrode connected to a plurality of the switches, an opposed electrode formed on one of the pair of transparent substrates and divided per a plurality of pixels, an electric field being applied between the pixel electrodes and the opposed electrode, and an image being displayed by controlling the orienting condition of the liquid crystal.

The selection signal level to be applied to the scanning line controlling condition of the switch and selection signal level to be applied to the opposed electrode may be selection signal level having at least two values, and a level shifter is provided for varying the level of an image data signal to be applied to the signal line corresponding to the selection signal level of the opposed electrode.

One block unit may be formed with a predetermined number of pixels, the scanning line selection signal level and the opposed electrode signal level for the same display on a plurality of pixels in the one block unit in one scanning period and the scanning line selection signal level and the opposed electrode signal level for selecting arbitrary pixel in the one block unit, Switching means is provided for switching the region for the same display on a plurality of pixels in the one block unit in one scanning period and the region permitting different display on a plurality of pixels in one block unit for a plurality scan times.

According to an eighth aspect of the present invention, an image displaying system comprises an image displaying apparatus having a display panel; an image generating device generating an image signal displaying on the display panel; a display control device controlling the image displaying apparatus on the basis of the image signal; and a frame memory for holding information corresponding to the image signal connected to the display control device, the image displaying apparatus including a dynamic image and a still image discriminating means for discriminating between the dynamic image and the still image, the display panel taking a predetermined number of pixels among a plurality of pixels arranged in matrix fashion as one block unit, and one screen image for displaying is formed by combining a dynamic image region for displaying the same information on a plurality of pixels in the one block unit during one scanning period and a still image region for permitting display of respectively different information on the plurality of pixels in the one block unit.

According to a ninth aspect of the present invention, an image displaying system comprises an image displaying apparatus having a display panel; an image generating device generating an image signal displaying on the display panel; a display control device controlling the image displaying apparatus on the basis of the image signal; and a frame memory for holding information corresponding to the image signal connected to the display control device, the display control device including a dynamic image and a still image discriminating means for discriminating between the dynamic image and the still image, the display panel taking a predetermined number of pixels among a plurality of pixels arranged in matrix fashion as one block unit, and one screen image for displaying is formed by combining a dynamic image region for displaying the same information on a plurality of pixels in the one block unit during one scanning period and a still image region for permitting display of respectively different information on the plurality of pixels in the one block unit.

According to a tenth aspect of the present invention an image displaying system comprises an image displaying apparatus having a display panel; an image generating device generating an image signal displaying on the display panel; a display control device controlling the image displaying apparatus on the basis of the image signal; and a frame memory for holding information corresponding to the image signal connected to the display control device, the image generating device including a dynamic image and a still image discriminating means for discriminating between the dynamic image and the still image, the display panel taking a predetermined number of pixels among a plurality of pixels arranged in matrix fashion as one block unit, and one screen image for displaying is formed by combining a dynamic image region for displaying the same information on a plurality or pixels in the one block unit during one scanning period and a still image region for permitting display of respectively different information on the plurality of pixels in the one block unit.

BRIEF DESCRIPTION OF THE DRAWINGS

The present invention will be understood more fully from the detailed description given hereinafter and from the accompanying drawings of the preferred embodiment of the present invention which, however, should not be taken to be limitative to the invention, but are for explanation and understanding only.

In the drawings.

DESCRIPTION OF THE PREFERRED EMBODIMENT

The present invention will be discussed hereinafter in detail in connection with various preferred embodiments of an image display apparatus according to the present invention and with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscurity of the present invention.

Figure 1:
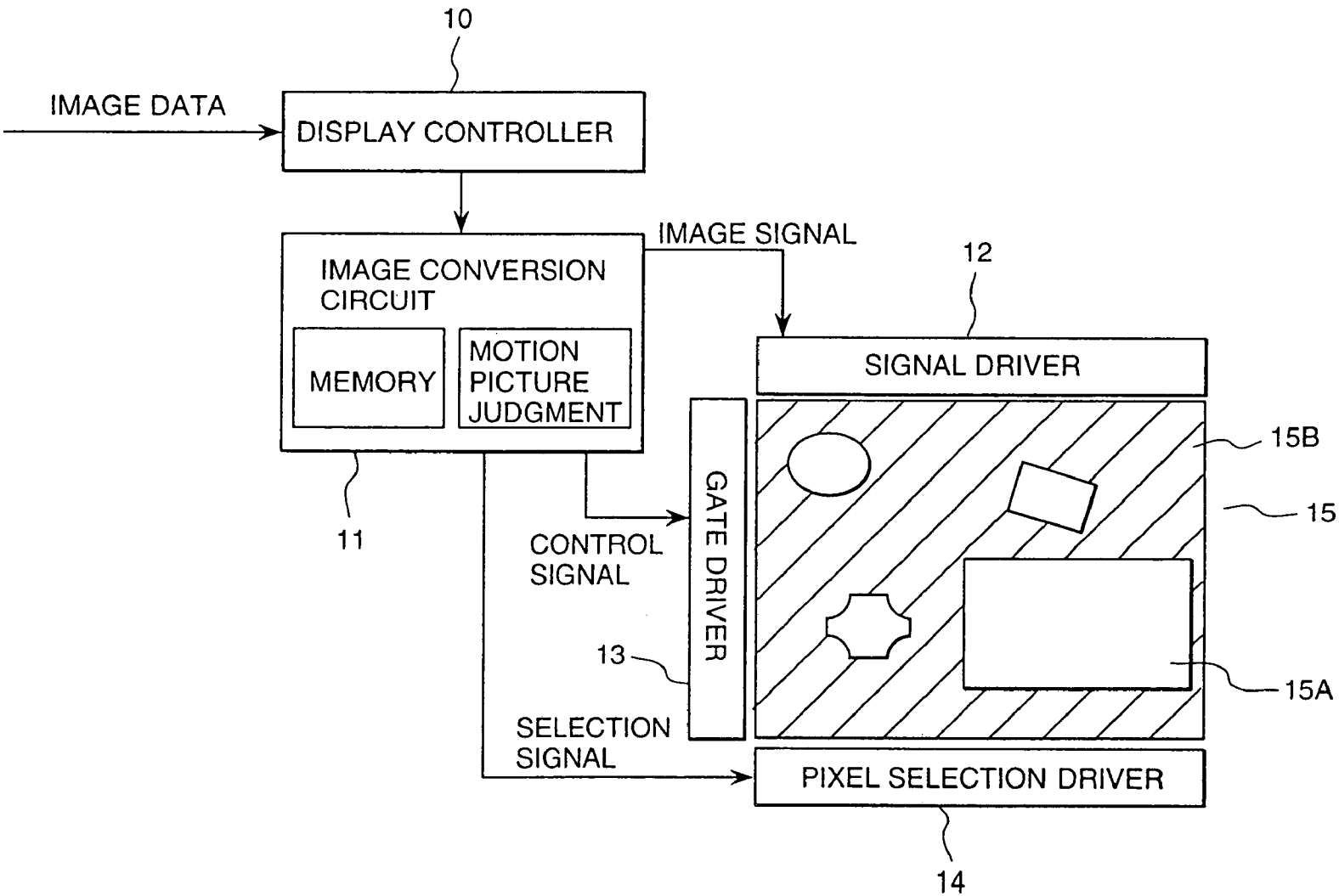
FIG. 1 is a block diagram showing the overall construction of an image display apparatus according to the present invention.

FIG. 1 is a block diagram showing the overall construction of an image display apparatus according to the present invention. This image display apparatus has a display controller 10, an image conversion circuit 11 and a display panel 15. The display controller 10 converts image data from a not shown image generating apparatus into display data. The image conversion circuit 11 includes a frame memory and a dynamic image judgment circuit feeding data at different resolutions to the display panel 15.

On the periphery of the display panel 15, there is provided a signal driver 12 for applying an image data signal to the display panel 15, a gate driver 13 for applying a scanning signal to the display panel 25 and a pixel selection driver 24 for applying a selection signal for selecting a display block.

The display panel 15 takes a plurality of pixels, among a large number of pixels arranged in the form of a matrix, as one block unit, and arbitrarily switches between a dynamic image region 15A displaying the same content on a plurality of pixels in one block in one scanning period simultaneously and a still image region 15B capable of respectively different displays over a plurality of pixels in one block in a plurality of scan times.

In the illustrated embodiment of the image display apparatus, data of low resolution is displayed simultaneously in one scanning period to realize smooth dynamic image display, and high resolution display of a still image by displaying data of high resolution during a plurality of scan times is achieved.

A detailed construction of the display panel 15 will be discussed later. The dynamic image region 15A displaying the same content on a plurality of pixels in one block in one scanning period simultaneously and the still image region 15B capable of respectively different displays on a plurality of pixels in one block during a plurality of scan times can be selected and can vary in size or in the display position on the basis of input signals input from the signal driver 12, the gate driver 13 and the pixel selection driver 14.

On the other hand, it is possible to switch the portion of the still image region 15B of FIG. 1 into the dynamic image region 15A, and to switch the current dynamic image region 15A into the still image region 15B.

Furthermore, a block can be divided into two sub-blocks, for example. Adapting to definition of the still image to be displayed, for the still image which can have a relatively low definition, it is possible to employ a system for displaying the same information on respective sub-blocks.

Throughout this disclosure, in the case of a color display, it is to be understand that one pixel is formed with three pixel components of red, green and blue. On the other hand, in the case of a monochrome display, one pixel is consisted of one pixel component.

[Writing/Holding Operation]

Figure 2:
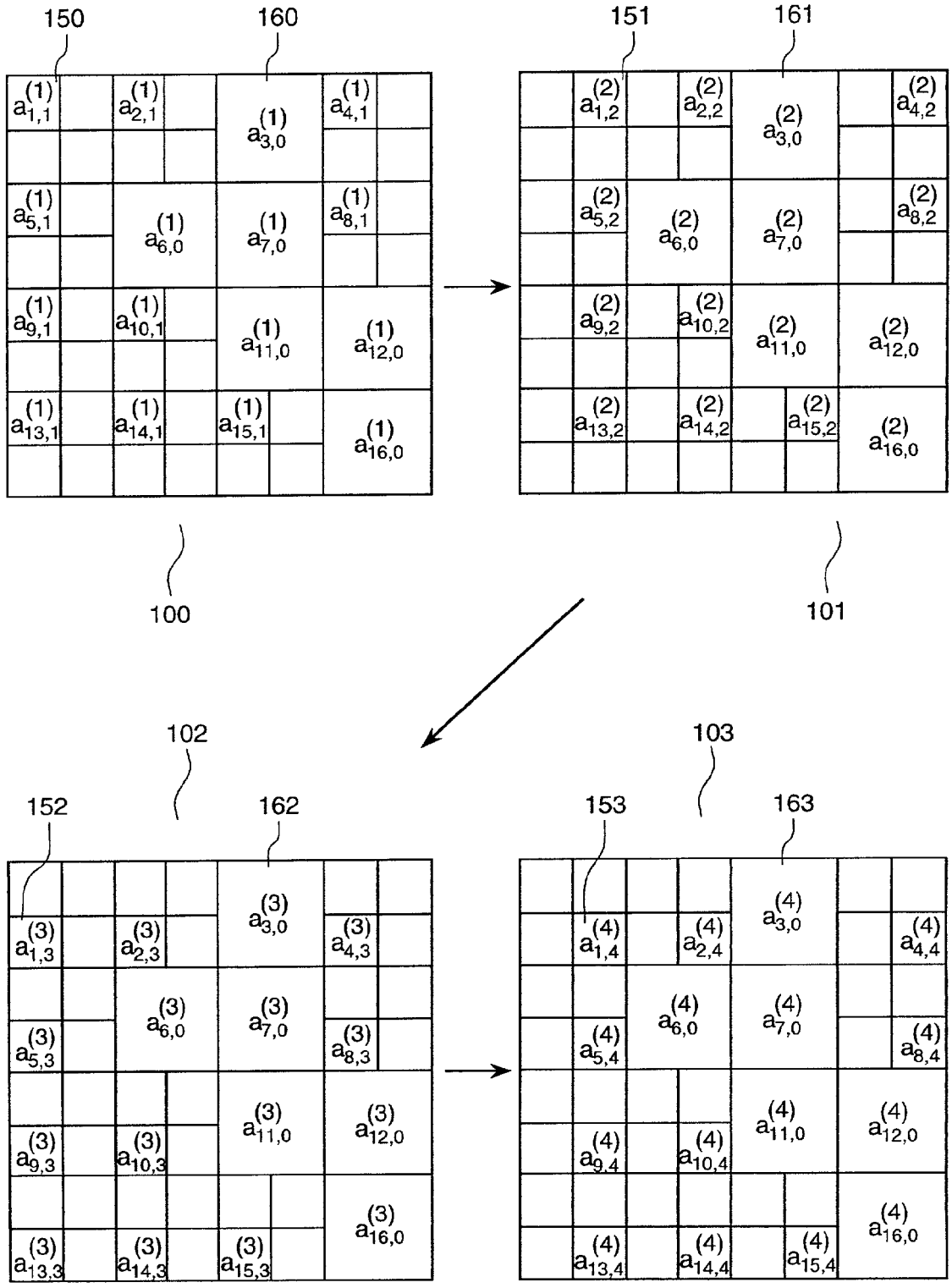
FIG. 2 is a flow diagram showing a part of a display area for illustrating the process of writing to pixels per frame in the embodiment shown in FIG. 1.

FIG. 2 is an enlarged diagrammatic view showing a part of a display area for illustrating the successive states in writing to pixels per frame in the embodiment shown in FIG. 1. In this embodiment, a 2 pixel×2 pixel arrangement of four pixels is defined as one block.

At first, in the first frame 100, in the high definition still image region, image data $a^{(1)}_{1.1}$ is written in a pixel component 150. Similarly, even in the other high definition still image regions, the image data is written in one pixel out of the respective four pixels of a block.

On the other hand, in the low definition dynamic image region, the same image data $a^{(1)}_{3.0}$ is written in four pixels 160. Similarly, even in the low definition dynamic image regions, the same image data is written in the respective four pixels of a block.

Next, in the second frame 101, in the high definition still image region, while maintaining the image data $a^{(1)}_{1.1}$ of the pixel 150 written in the preceding frame, image data $a^{(2)}_{1.2}$ is newly written in the pixel 151 in the same pixel block as the pixel 150. Similarly, in the other high definition still image regions, image data is newly written in the pixels different from those written in the first frame in the same pixel blocks.

On the other hand, in the low definition dynamic image region, the same new image data $a^{(2)}_{3.0}$ are written for four pixels 161 of the same pixel block. Similarly, in other low definition dynamic image regions, the same new image data is written for the respective four pixels in the same pixel blocks.

Next, in the third frame 102, in the high definition still image region, while maintaining the image data of the pixels 150 and 151 written in the first and second frames, image data $a^{(3)}_{1.3}$ is newly written in the pixel 152 in the same pixel block as the pixels 150 and 151. Similarly, in the other high definition still image regions, image data is newly written in the pixels different from those written in the first and second frames in the same pixel blocks.

On the other hand, in the low definition dynamic image region, the same new image data $a^{(3)}_{3.0}$ is written for four pixels 162 of the same pixel block. Similarly, in other low definition dynamic image regions, the same new image data is written for the respective four pixels in the same pixel blocks.

Next, in the fourth frame 103, in the high definition still image region, while maintaining the image data of the pixels 150 and 151 written in the first and second frames, image data $a^{(4)}_{1.4}$ is newly written in the pixel 153 in the same pixel block as the pixels 150, 151 and 152. Similarly, in the other high definition still image regions, image data is newly written in the pixels different from those written in the first, second and third frames in the same pixel blocks.

On the other hand, in the low definition dynamic image region, the same new image data $a^{(4)}_{3.0}$ is written for four pixels 163 of the same pixel block. Similarly, in other low definition dynamic image regions, the same new image data is written for the respective four pixels in the same pixel blocks.

By repeating the foregoing steps, the high definition still image regions and the low definition dynamic image regions are displayed in arbitrary regions in the display area.

The high definition still image region forms a high definition image in four frames and the low definition dynamic image region displays new data per one frame. Accordingly, a still image not varying in four frames can be displayed in high definition, and the dynamic image moving quickly can be displayed at high speed per one frame.

Throughout this disclosure, the system of display in which the resolution is varied in an arbitrary region in the display area, as set forth above, will be referred to as an image zone separating display system.

First Embodiment

Figure 3:
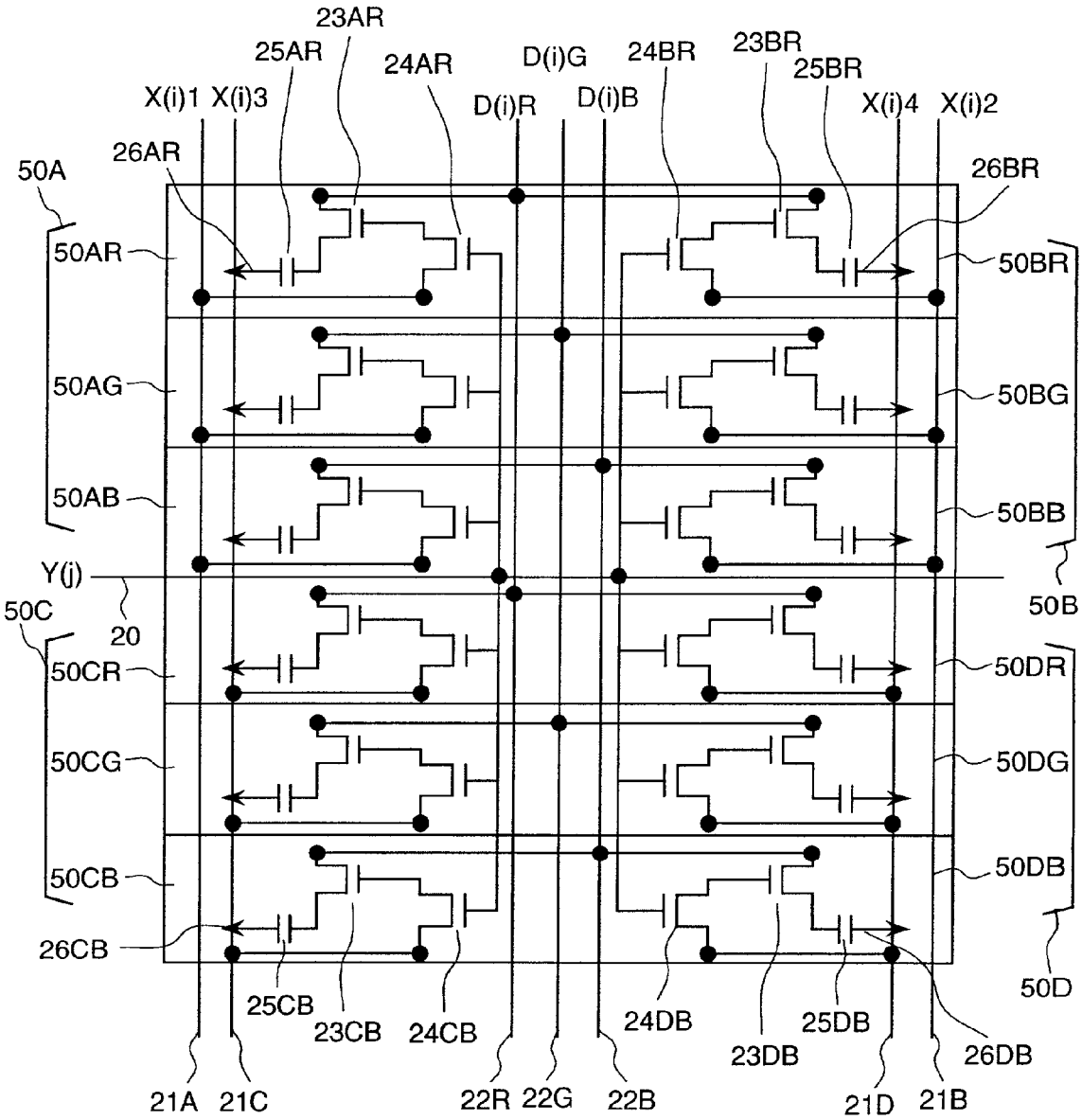
FIG. 3 is a schematic circuit diagram showing the first embodiment of a pixel circuit construction for realizing an image zone separating display according to the present invention.

FIG. 3 is a circuit diagram showing an embodiment of a pixel circuit construction for realizing image zone separating display according to the present invention.

The first embodiment is directed to a pixel circuit construction taking a 2 pixels×2 pixels arrangement as one block. A plurality of such pixel circuit constructions are arranged for forming an overall display area of the display panel 15. It should be noted that one pixel block does not necessarily consist of four pixels, but can be any reasonable number. However, in consideration of a lowering of the opening ratio due to an increase in the number of lines and so forth, it is preferred to form one pixel block with four pixels.

It should be noted that the image display apparatus employing the image zone separating display system of the present invention is not only applicable for a liquid crystal display, but also may be applied to an ELD, FED, PDP and so forth. Here, the present invention will be discussed in terms of a liquid crystal display device as the most preferred example.

The first embodiment of a liquid crystal display device, which has a lighting device on a back surface and includes a pair of transparent substrates having a polarizing panel and a liquid crystal layer sandwiched between a pair of transparent substrates, controls the orienting condition of the liquid crystal layer by applying an electrical field to the liquid crystal layer for displaying an image.

Figure 4:
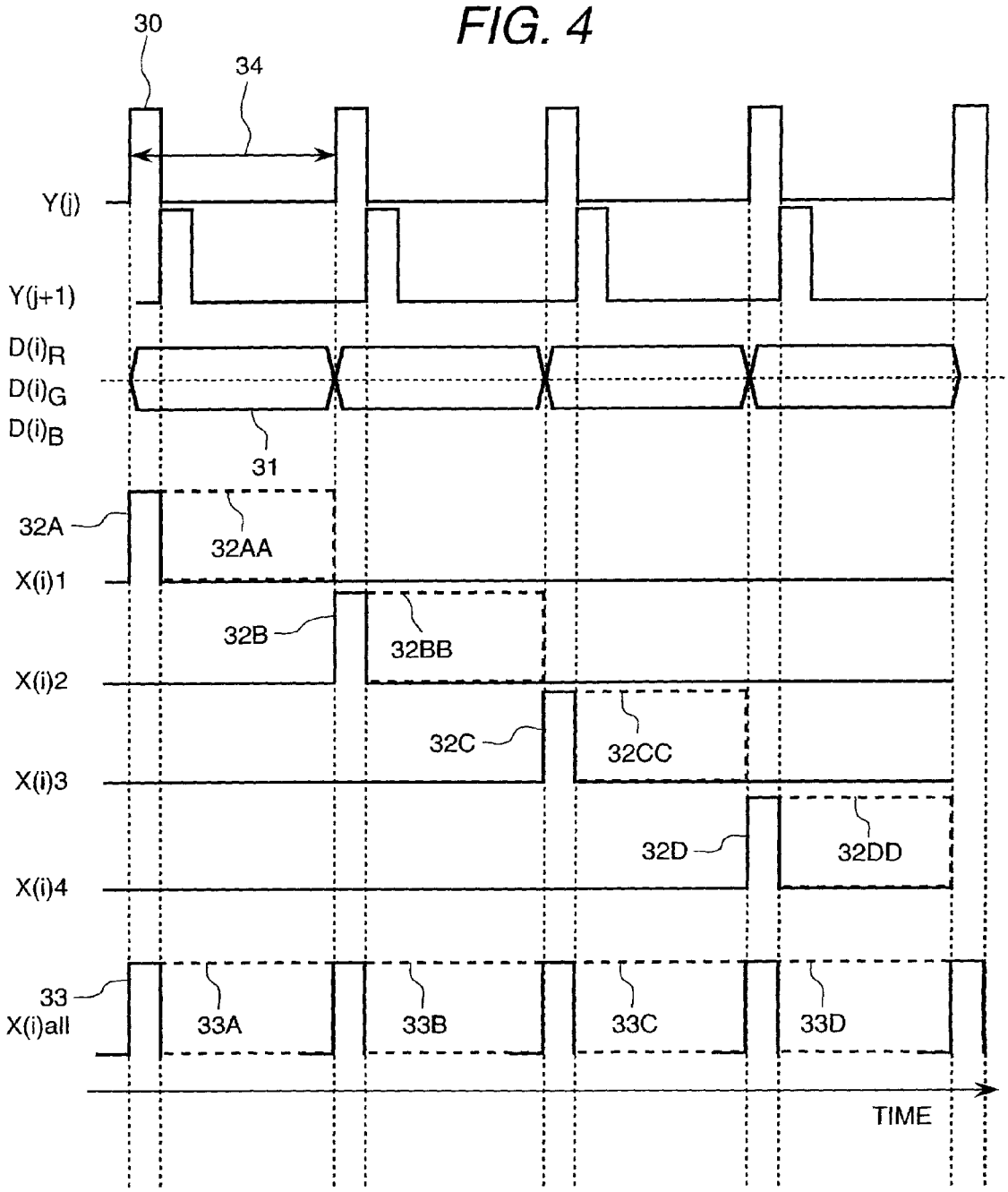
FIG. 4 is a timing chart showing one example of a driving voltage waveform to be applied for each line of the circuit of FIG. 3 in order to produce an image zone separation display according to the present invention.

In the circuit construction of one pixel block constituted of four pixels, as shown in FIG. 4, concerning respective components, the upper left pixel is identified by A, the upper right pixel is identified by B, the lower left pixel is identified by C and the lower right pixel is identified by D. Furthermore, R, G, B designations correspond to respective red, green and blue pixels.

In the first embodiment, one block is constituted with four pixels 50A, 50B, 50C and 50D. The pixel 50A is formed by three pixel components consisting of red pixel component 50AR, green pixel component 50AG and blue pixel component 50AB. The pixel 50B is formed by three pixel components consisting of red pixel component 50BR, green pixel component 50BG and blue pixel component 50BB. The pixel 50C is formed by three pixel components consisting of red pixel component 50CR, green pixel component 50CG and blue pixel component 50CB. The pixel 50D is formed by three pixel components consisting of red pixel component 50DR, green pixel component 50DG and blue pixel component 50DB.

Scanning line 20 common to four pixels is formed at the center. To the scanning line 20, gates, such as twelve thin film transistors 24AR, 24BR, 24CB and 24DB operating as a first switch and so forth are connected.

To drain electrodes of the thin film transistors 24AR, 24AG and 24AB, operating as the first switches, a block selection signal line 21A is connected. To drain electrodes of the thin film transistors 24BR, 24BG and 24BB, a block selection signal line 21C is connected. To drain electrodes of the thin film transistors 24CR, 24CG and 24CB, a block selection signal line 21C is connected. To drain electrodes of the thin film transistors 24DR, 24DG and 24DB, a block selection signal line 21D is connected.

The thin film transistors 24AR, 24AG and 24AB, operating as the first switches, are switches for selecting the pixel 50A, respectively. These first switches may be a common single switch. Similarly, concerning the pixels 50B, 50C and 50D, the first switches may be provided as common single switches.

To source electrodes of the thin film transistors, operating as the first switches, twelve gate electrodes, such as thin film transistors 23AR, 23BR, 23CB, 23DB and so forth, operating as second switches, are connected.

To drain electrodes of thin film transistors, operating as second switches, respective ones of the red color image signal line 22R, the green color image signal line 22G and the blue color image signal line 22B are connected.

To the source electrodes of the thin film transistors, operating as the second switches, electrodes of respective pixel components are connected. Across the liquid crystal layer, opposed electrodes 26AR, 26BR, 26CB, 26DB and so forth are connected for forming pixel components 25AR, 25BR, 25CB, 25DB and so forth.

Opposed electrodes are common electrodes for all pixels. In respective ones of the pixel components 25AR, 25BR, 25CB, 25DB and so forth, holding capacitors are formed in parallel.

By employing such a pixel circuit construction, the image zone separating display discussed in connection with FIG. 2 can be performed.

On the other hand, in the illustrated embodiment, in FIG. 3, to the gates of the first switches, a scanning line 20 is connected, and to the drain electrodes of the first switches, block selection signal lines are connected. However, in the alternative, it is possible to adopt a circuit construction in which the block signal selection lines per pixel are connected to respective gates and scanning line 20 is connected to the drain electrodes of all four pixels.

FIG. 4 is a timing chart showing one example of the driving voltage waveform applied to each line of FIG. 3 for image zone separation display. Considering the (j)th scanning line Y(j), on the scanning line Y(j), a gate voltage 30 for turning ON the thin film transistor as the first switch is applied per a frame period 34. In synchronism with the gate electrode 30, voltages 32A to 32D are applied to respective block selection signal lines $X(i)_1$ to $X(i)_4$, 21A to 21D per four blocks and an image signal 31 corresponding to the red color $(i)_R$, green color $(i)_G$ and blue color $(i)_B$ is applied to the pixel through the second switch in synchronism with the gate voltage 30, in the region for high definition display.

Accordingly, only one of the pixels 50A, 50B, 50C and 50D is selected. Also, in the pixels that are not selected, voltages are held for four frames.

On the other hand, in the region in which low definition display is to provided, a voltage 33 is applied to block selection signal line $X(i)_{all}$ as 21A to 21D, respectively per frame. The image signal 31 corresponding to the red color $(i)_R$, green color $(i)_G$ and blue color $(i)_B$ is applied to the pixel through the second switch in synchronism with the gate voltage 30. Accordingly, the same signal is applied for all pixels 50A, 50B, 50C and 50D for enabling rewriting of the display common to four pixels.

Concerning the (j+1)th scanning line Y(j+1), similarly to the (j)th scanning line, the high definition display region and the low definition display region are discriminated. When the driving waveform is input, image zone separating display can be performed.

Accordingly, when a still image is displayed on the high definition display region and a dynamic image is displayed on the low definition display region, the dynamic image is rewritten and the still image is displayed in high definition.

Second Embodiment

Figure 5:
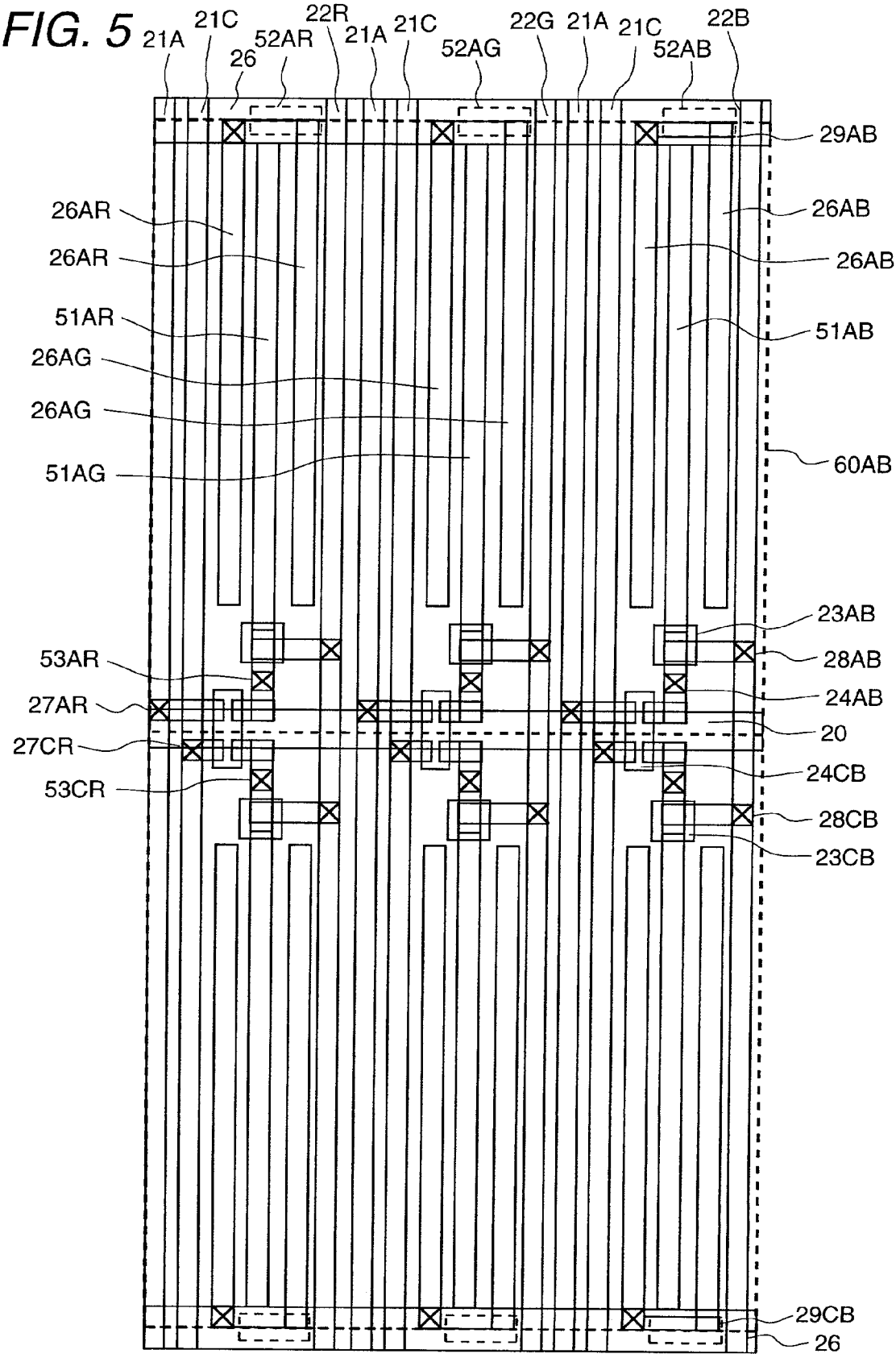
FIG. 5 is a plan view showing a second embodiment of a pixel structure pattern for realizing an image zone separation display according to the present invention.

FIG. 5 is a plan view of a pixel structure pattern for realizing an image zone separation display according to the present invention.

This second embodiment is provided with a pixel electrode and an opposed electrode on the same substrate and is a system for applying a lateral electric field to the liquid crystal layer. In this embodiment, an arrangement of 2×2 pixels are taken as one block unit. A plurality of block units are arranged for forming the entire display area. The number of pixels forming one block unit is not limited to four but can be any number. However, in consideration of a lowering of the opening ratio due to an increase in the number of lines and so forth, it is preferred to form one pixel block with four pixels.

It should be noted that an image display apparatus employing the image zone separating display system of the present invention is not only applicable to a liquid crystal display, but is also applicable to an ELD, FED, PDP and so forth. Here, the present invention will be described in terms of a liquid crystal display as the most preferred example.

The second embodiment of the liquid crystal display device, which has a lighting device on a back surface and includes a pair of transparent substrates having a polarizing panel and a liquid crystal layer sandwiched between a pair of transparent substrates, controls the orienting condition of the liquid crystal layer by applying an electrical field to the liquid crystal layer for displaying an image.

In the second embodiment, one pixel consists of three pixel components of red, green and blue, and one block consists of four pixels.

It should be noted that in FIG. 5 only two pixels are shown for the purpose of illustration. Respective components associated with the upper left pixel are identified by adding A following the reference numerals which identify the elements thereof, and respective components associated with the lower left pixel are identified by adding C in the same manner. Corresponding to pixel components of red, green and blue, the designations R, G and B are added to the reference numerals. Accordingly, among the four pixels, the upper right pixel B and the lower right pixel D are not illustrated. The scanning line 20 common to four pixels is formed at the center. To the scanning line 20, the gates of the thin film transistors 24AB, 24CB and so forth, operating as the first switch, are connected. In the second embodiment, a color filter has a stripe structure are arranged perpendicular to the scanning line 20.

To drain electrodes of the thin film transistors 24AB, and 24CB, operating as the first switches, block selection signal lines 21A and 21C are respectively connected by contact portions 27AB and 27CB.

To the source electrodes of the thin film transistors, operating as the first switch, gate electrodes of the thin film transistors 23AB and 23CB, operating as the second switch, are respectively connected by the contact portions 53AB and 53CB.

To the drain electrodes of the thin film transistors, operating as the second switches, respective ones of the red color image signal line 22R, green color image signal line 22G and blue color image signal line 22B are connected through contact portions 28AR, 28AG and 28AB.

To the source electrodes of the thin film transistors, operating as the second switches, respective electrodes 51AR, 51AG and 51AB of the pixel components are connected, and across the liquid crystal layer, opposed electrodes 24AR, 26BR, 26CB and 26DB and so forth are connected. The opposed electrodes are electrodes used in common for all pixels. It should be noted that the holding capacitors 52AR, 52AG and 52AB of the pixel components are formed in parallel with respective pixel components. In the illustrated embodiment, electrodes at different layers are connected by the contact portions 27, 28, 29, 53 and so forth. The layer structure is not limited to the example shown in the drawing.

By employing the second embodiment of the pixel structure and driving the same in a similar manner as the first embodiment, image zone separation display becomes possible.

Third Embodiment

Figure 6:
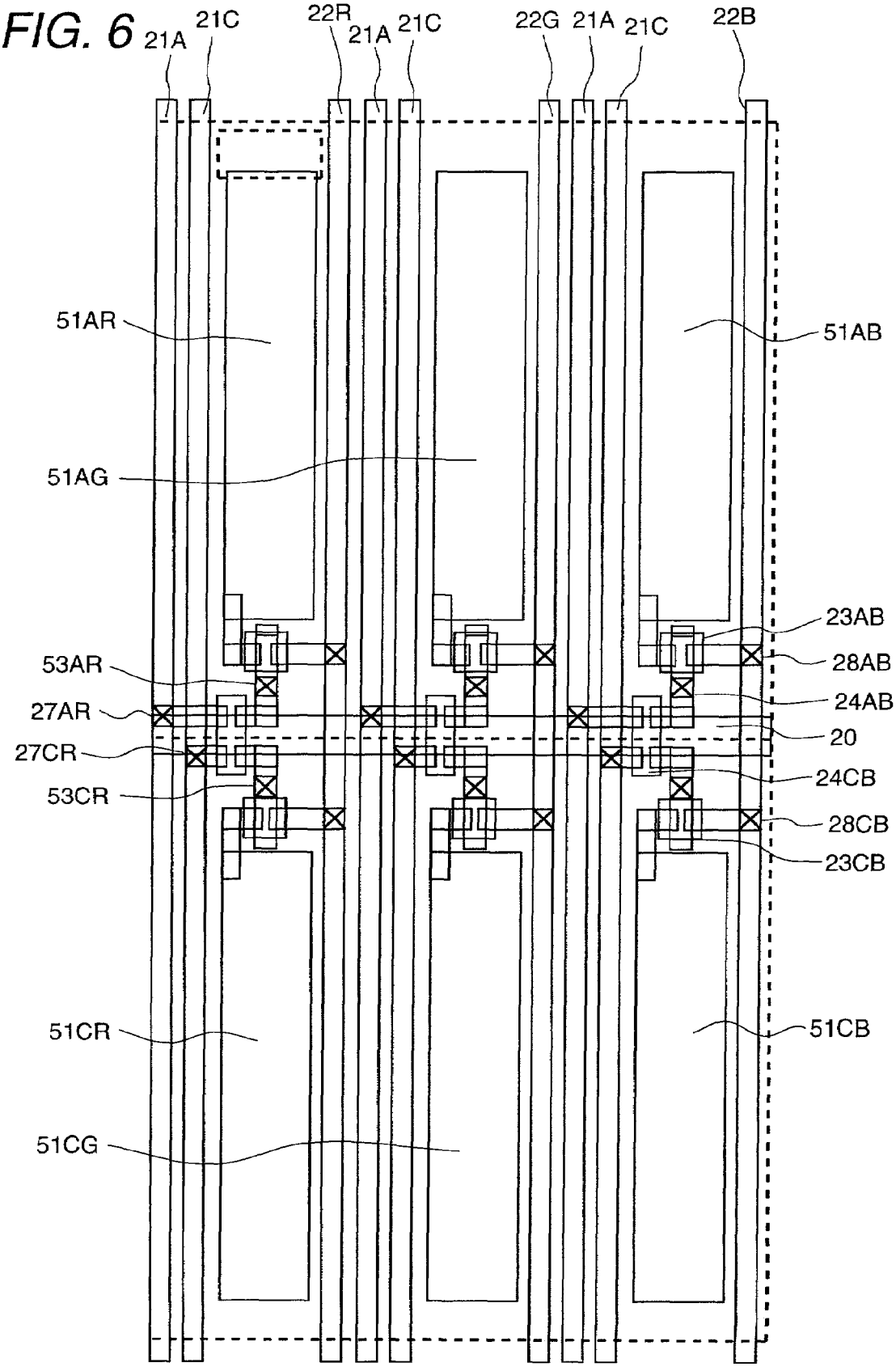
FIG. 6 is a plan view showing a third embodiment of a pixel structure pattern for realizing an image zone separation display according to the present invention.

FIG. 6 is a plane view of a third embodiment of the pixel structure pattern for realizing an image zone separation display according to the present invention. The third embodiment has a pixel electrode on one of a pair of transparent substrates and an opposed electrode on the other transparent substrate. A vertical electric field is applied the liquid crystal layer. In the third embodiment, a color filter has a stripe structure perpendicular to the scanning line 20.

The scanning line 20 which is provided in common for four pixels is formed at the center. To the scanning line 20, the gates of the thin film transistors 24AB, 24CB are connected. To drain electrodes of the thin film transistors 24AB and 24CB, operating as the first switches, block selection signal lines 21A and 21C are respectively connected by contact portions 27AB and 27CB.

To the source electrodes of the thin film transistors, operating as the first switch, gate electrodes of the thin film transistors 23AB and 23CB, operating as the second switch, are connected by the contact portions 53AB and 53CB.

To the drain electrodes of the thin film transistors, operating as the second switch, respective ones of the red color image signal line 22R, green color image signal line 22G and blue color image signal line 22B are respectively connected through contact portions 28AR, 28AG and 28AB.

To the source electrodes of the thin film transistors, operating as the second switches, respective electrodes 51AR, 51AG and 51AB of the pixel components are connected, and across the liquid crystal, layer, opposed electrodes 24AR, 26BR, 26CB and 26DB and so forth are connected. The opposed electrodes are electrodes provided in common for all pixels. It should be noted that the holding capacitors 52AR, 52AG and 52AB of the pixel components are formed in parallel with respective pixel components. In the illustrated embodiment, electrodes at different layers are connected by the contact portions 27, 28, 53 and so forth. The layer structure is not limited to the example shown in the drawing.

Employing the third embodiment of the pixel structure and driving the same in similar manner as the first embodiment, image zone separation display becomes possible.

Fourth Embodiment

Figure 7:
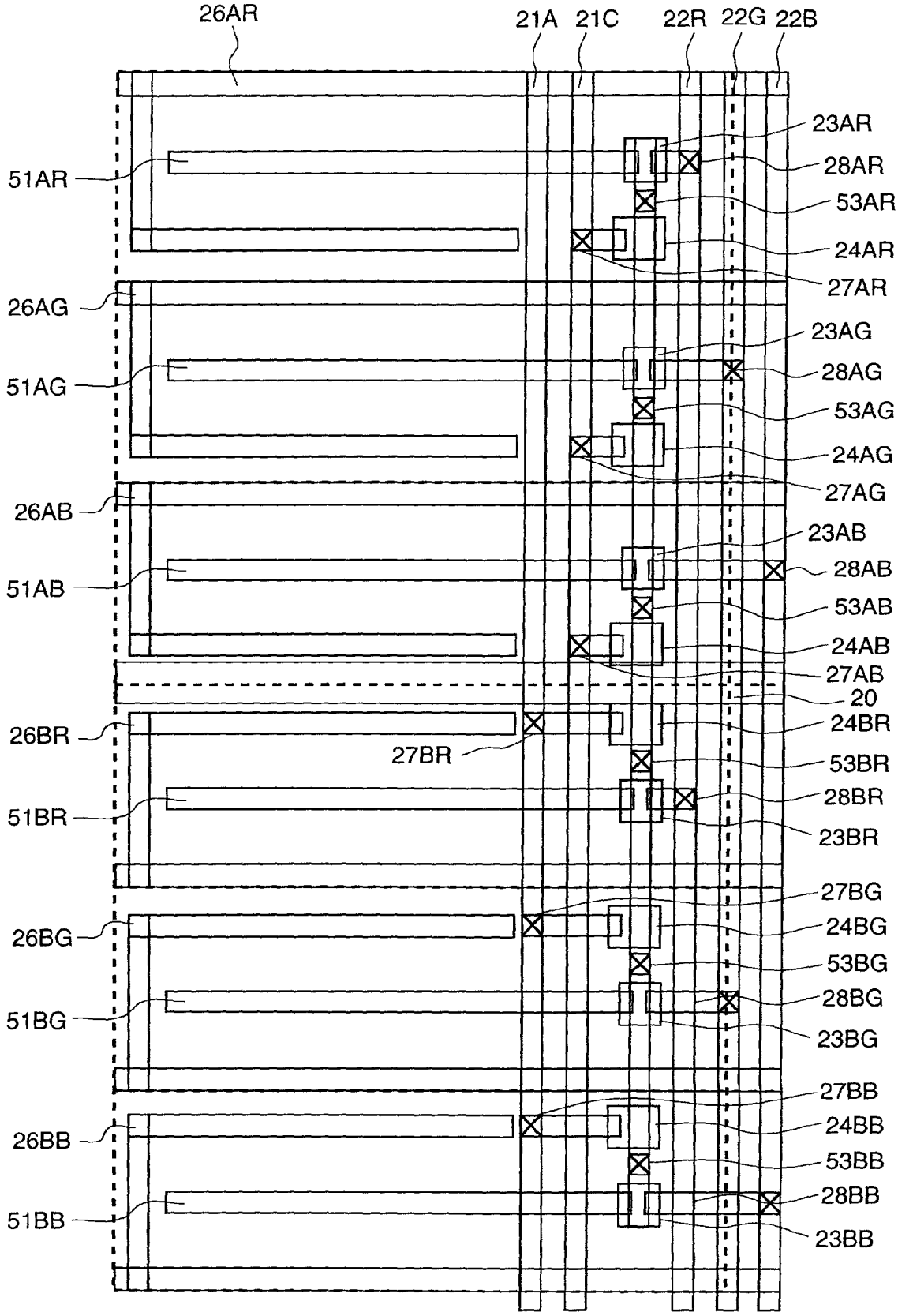
FIG. 7 is a plan view showing a fourth embodiment of a pixel structure pattern for realizing an image zone separation display according to the present invention.

FIG. 7 is a plane view of a fourth embodiment of the pixel structure pattern for realizing the image zone separation display according to the present invention. The fourth embodiment is substantially the same as the second embodiment except for the color filter which is constructed with a stripe structure arranged parallel to the scanning line 20.

By employing the construction of the fourth embodiment, the opening ratio can be increased in comparison with the second embodiment.

Fifth Embodiment

Figure 8:
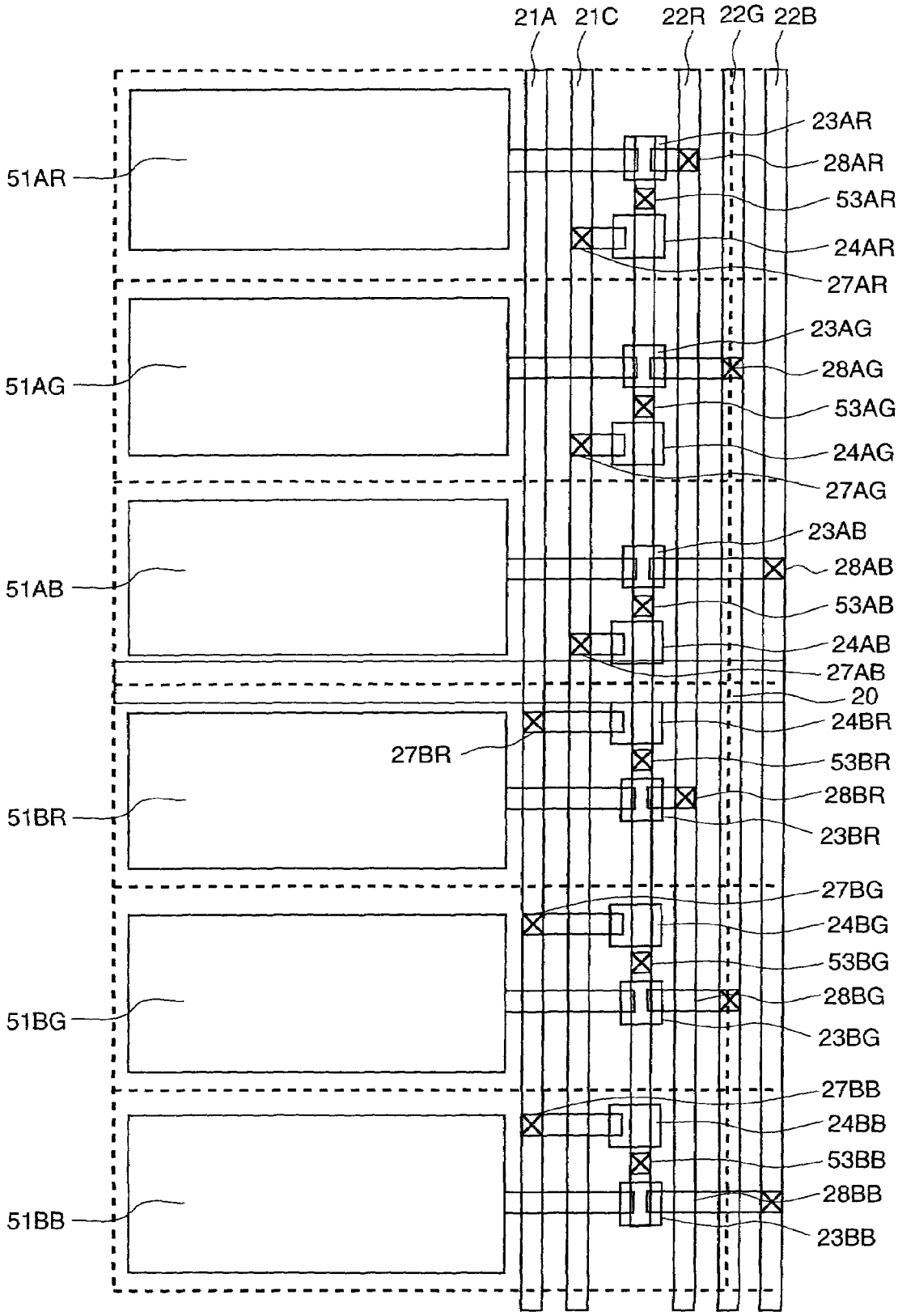
FIG. 8 is a plan view showing a fifth embodiment of a pixel structure pattern for realizing an image zone separation display according to the present invention.

FIG. 8 is a plane view of a fifth embodiment of the pixel structure pattern for realizing the image zone separation display according to the present invention. The fifth embodiment is substantially the same as the second embodiment except for the color filter which is constructed with a stripe structure arranged parallel to the scanning line 20.

By employing the construction of the fifth embodiment, the opening ratio can be risen in comparison with the third embodiment.

Sixth Embodiment

Figure 9:
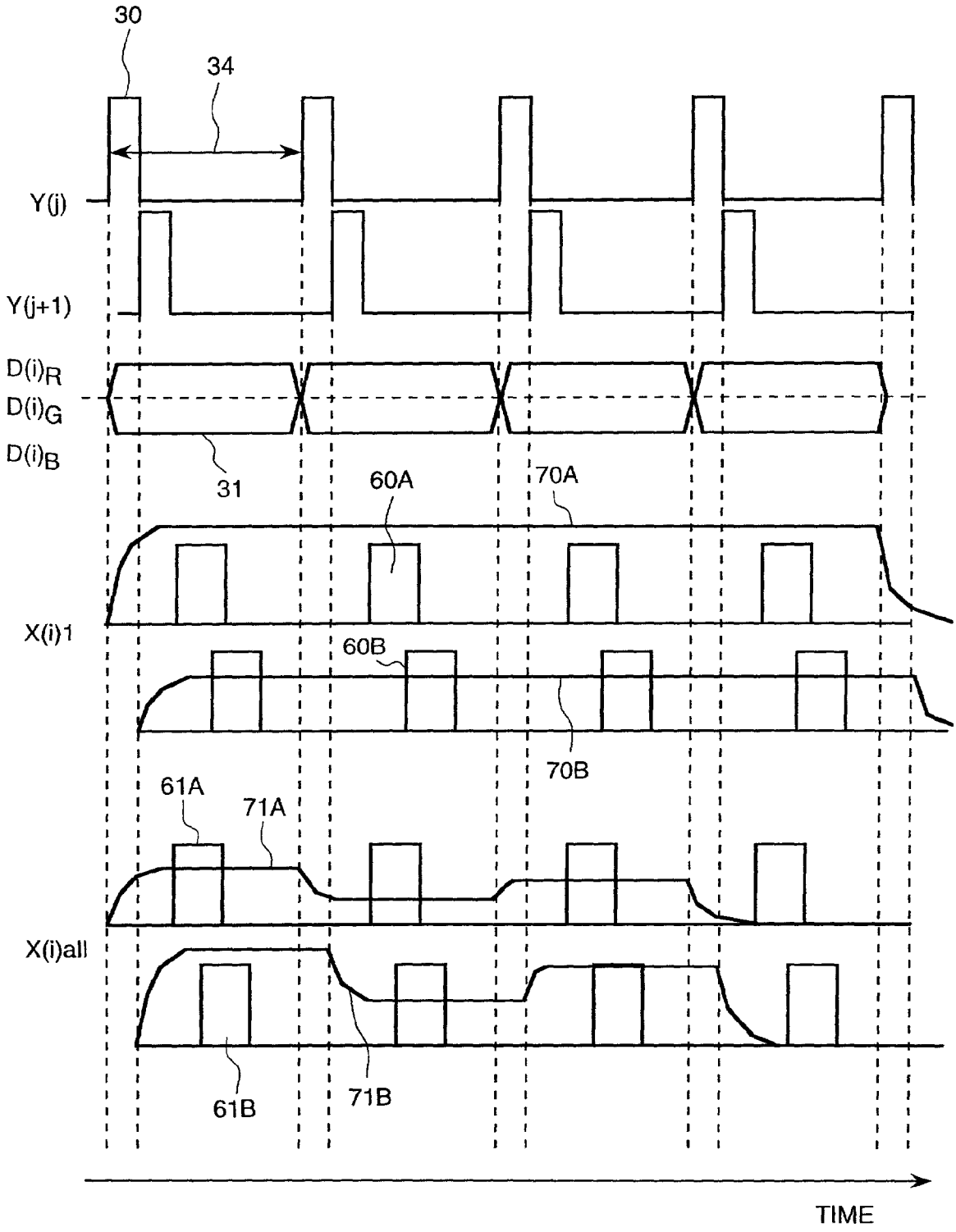
FIG. 9 is a timing chart showing operation waveforms of the sixth embodiment in which a back light is used for obtaining a clear dynamic image, in an image zone separation display system according to the present invention.

FIG. 9 is a timing chart showing the operation waveforms of an embodiment which employs a blink back light for obtaining a clear dynamic image in the image zone separation display system according to the present invention. This feature is applicable to any of the embodiments having two switches in one pixel component.

The sixth embodiment of the liquid display also has a lighting device on the back surface, a pair of transparent substrates having a polarizing panel, and a liquid crystal layer disposed between the pair of transparent substrates. By applying an electric field to the liquid crystal layer, the orienting condition of the liquid crystal is controlled for displaying an image.

Upon production of a high resolution display, the coefficient of transmission of the liquid crystal layer is varied as seen by curves 70A and 70B, and upon production of a low definition display, the coefficient of transmission of the liquid crystal layer is varied as seen by curves 71A and 71B. When the lighting device is illuminated as shown by curves 60A, 60B, 61A and 61B in synchronism with the response of the liquid crystal, a clear image can be obtained within a region rewritten at high speed and at low definition.

When illumination of the lighting device dividing the high definition region and the low definition region is difficult, in order to prevent fluctuation of the brightness in the high definition region and of the brightness in the low definition region, illumination of the lighting device has to be blinked in synchronism with the scanning line signal 30.

Seventh Embodiment

Figure 10:
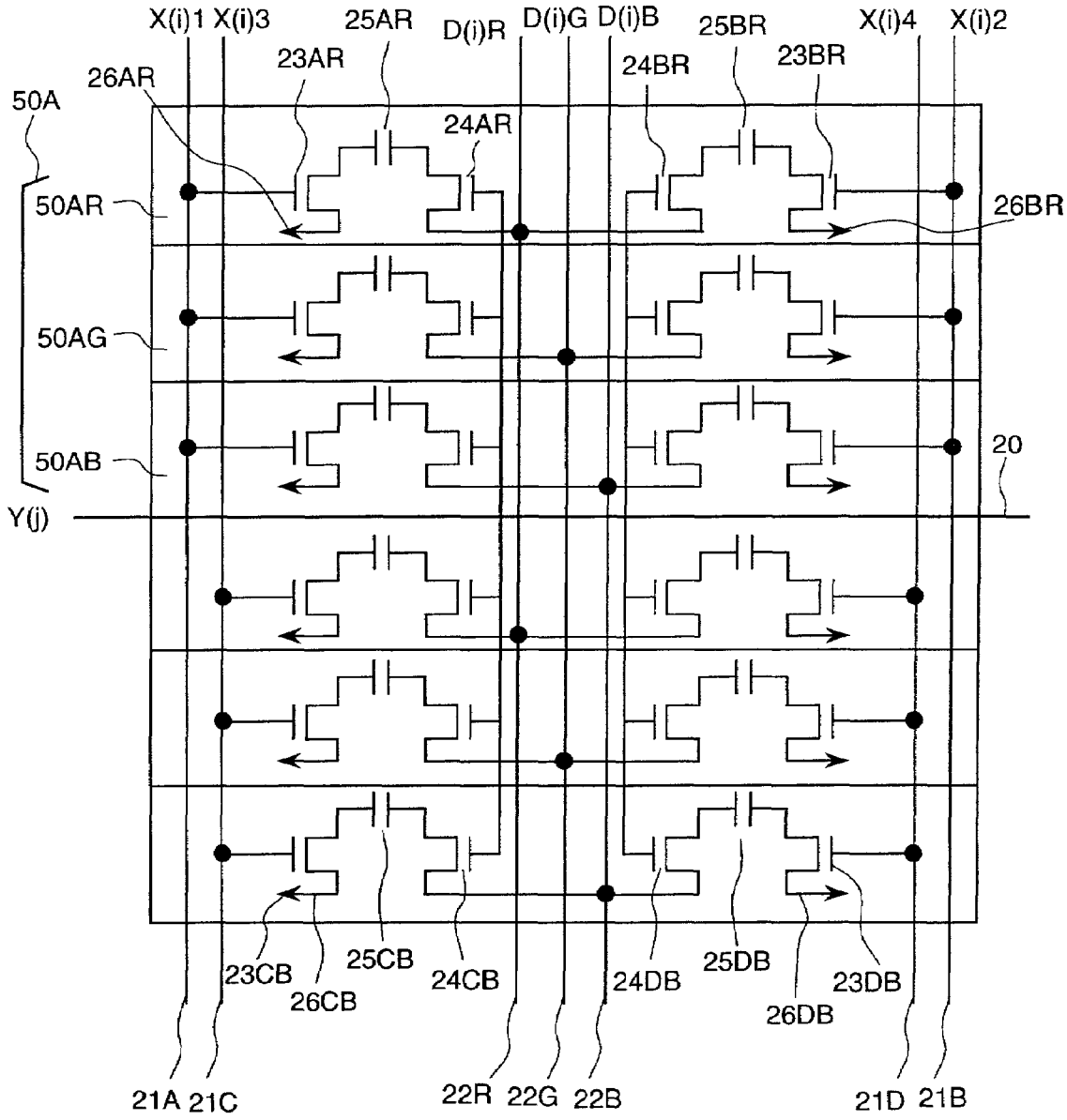
FIG. 10 is a schematic circuit diagram showing a seventh embodiment of a pixel circuit construction for realizing an image zone separation display by the present invention.

FIG. 10 is a circuit diagram showing a seventh embodiment of the pixel circuit construction for realizing the image zone separation display according to the present invention. This embodiment has a pixel circuit construction in which an arrangement of 2×2 pixels is taken as one block unit. A plurality of block units are arranged to form the entire display area. The number of pixels forming one block unit is not limited to four but can be any number. However, in consideration of a lowering of the opening ratio due to an increase in the number of lines and so forth, it is preferred to form one pixel block with four pixels.

It should be noted that an image display apparatus employing the image zone separating display system of the present invention is not only applicable to a liquid crystal display device, but is also applicable to an ELD, FED, PDP and so forth. Here, the present invention will be described in terms of a liquid crystal display as the most preferred example.

The seventh embodiment of the liquid crystal display device, which has a lighting device on a back surface and includes a pair of transparent substrates having a polarizing panel and a liquid crystal layer sandwiched between a pair of transparent substrates, controls the orienting condition of the liquid crystal layer by applying an electrical field to the liquid crystal layer for displaying an image.

In the seventh embodiment, one pixel consists of three pixel components consisting of a red pixel component 50AR, a green pixel component 50AG and a blue pixel component 50AB, and one block is consists of four pixels 50A, 50B, 50C and 50D.

In the circuit construction of one pixel block constituted by four pixels, as shown in FIG. 10, concerning respective components, the upper left pixel is identified by the designation A, the upper right pixel is identified by the designation B, the lower left pixel is identified by the designation C and the lower right pixel is identified by the designation D. Furthermore, designations R, G, B are appended to respective ones of red, green and blue pixels.

Scanning line 20 provided in common for four pixels is formed at the center. To the scanning line 20, gates, such as twelve thin film transistors 24AR, 24BR, 24CB and 24DB, operating as a first switch are connected.

To the gate electrodes of the thin film transistors 23AR, 23AG, 23AB, operating as a second switch, the block selection signal line 21A is connected. To the gate electrodes of the thin film transistors 23BR, 23BG, 23BB, operating as a second switch, the block selection signal line 21B is connected. To the gate electrodes of the thin film transistors 23CR, 23CG, 23CB, operating as a second switch, the block selection signal line 21C is connected. To the gate electrodes of the thin film transistors 23DR, 23DG, 23DB, operating as a second switch, the block selection signal line 21D is connected.

To the drain electrodes of the second switches, the electrodes 26AR, 26BR, 26CB, 26DB and so forth are connected and are respectively provided in common. To the drain electrode of the thin film transistors of the first switch, respective ones of the red color image signal line 22R, the green color image signal line 22G and the blue color image signal line 22B are connected.

The source electrodes of the thin film transistors, operating as the first switch, serve as electrodes of the pixel components. To the twelve source electrodes of the thin film transistors 23AR, 23BR, 23CB, 23DB and so forth, operating as the second switch, opposed electrodes are formed. By sandwiching the liquid crystal layer between the pixel electrode and the opposed electrode, pixel components 25AR, 25BR, 25CB, 25DB and so forth are formed.

By employing the pixel construction of the seventh embodiment, and driving the same in similar manner as the first embodiment, an image zone separation display becomes possible. On the other hand, in the illustrated embodiment, while the scanning line 20 is connected to the gate electrode of the first switch and the block selection signal line is connected to the gate electrode of the second switch in FIG. 10, instead of this, the block selection signal line may be connected to the gate electrode of the first switch per pixel, and the scanning line 20 may be connected to the gate electrode of the second switch of all four pixels.

It should be noted that the driving voltage waveform applied to respective lines for image zone separation display is the same as that shown in FIG. 4 in connection with the first embodiment. Accordingly, when a still image is displayed in the high definition region and a dynamic image is displayed in the low definition region, the dynamic image and still image are displayed in an admixed manner, the dynamic image is rewritten at a high speed and the still image is displayed with a high definition.

Eighth Embodiment

Figure 11:
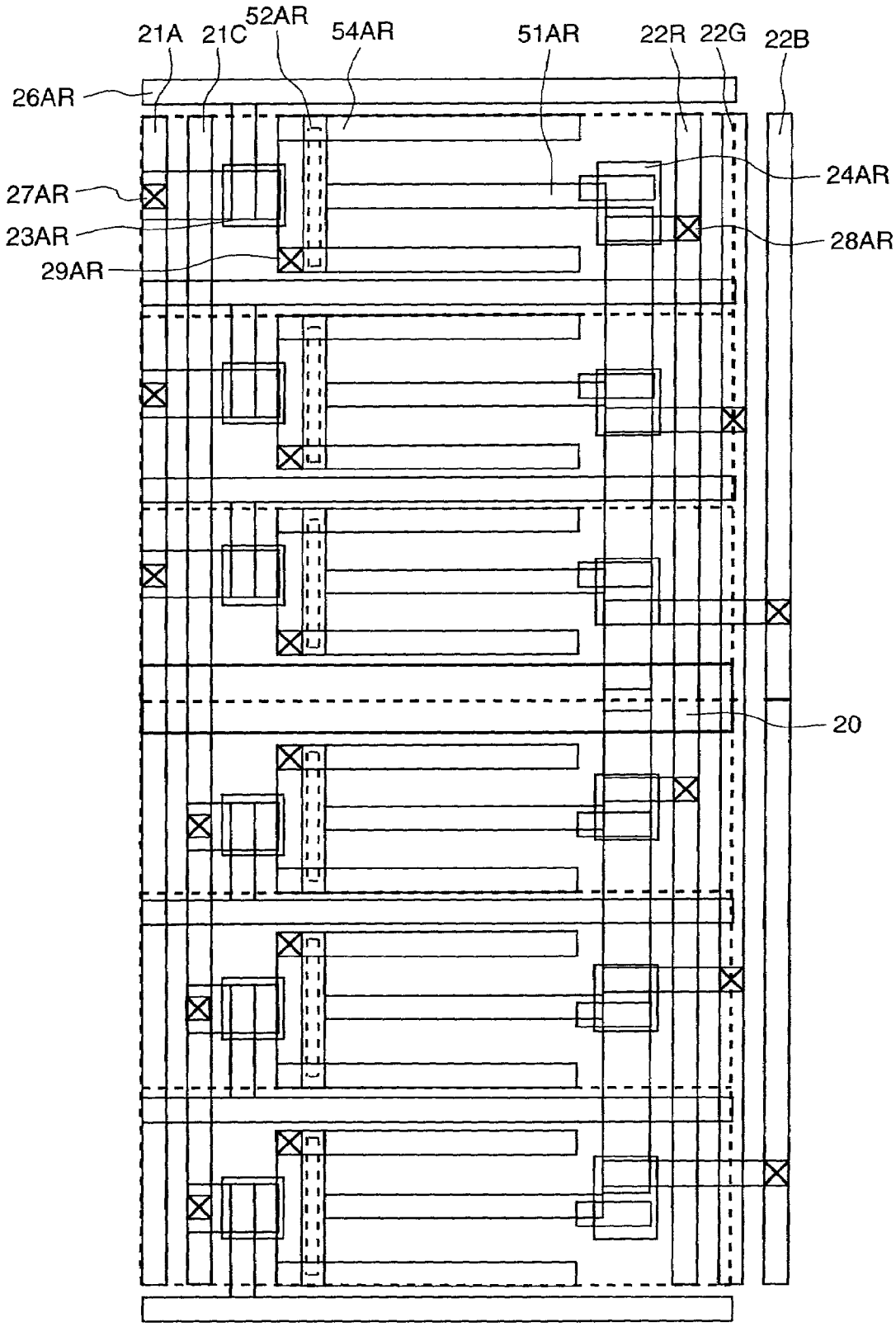
FIG. 11 is a plan view showing an eighth embodiment of a pixel structure pattern for realizing an image zone separation display according to the present invention.

FIG. 11 is a plan view showing an eighth embodiment of a pixel structure pattern for realizing image zone separation display according to the present invention.

The eighth embodiment is directed to a system for applying a lateral electric field to the liquid crystal layer, with the pixel electrode and the opposed electrode being provided on the same substrate as used in the seventh embodiment. The color filter has a stripe structure arranged in parallel to the scanning line 20 to improve the opening ratio. However, the color filter may have a stripe structure arranged perpendicular to the scanning line 20.

On the other hand, in the eighth embodiment, while the electrodes at different layers are connected by contact portions 27, 28, 29 and so forth, the layer structure is not limited to the structure shown in the drawing.

Other operations and effects of the eighth embodiment are similar to the seventh embodiment.

Ninth Embodiment

Figure 12:
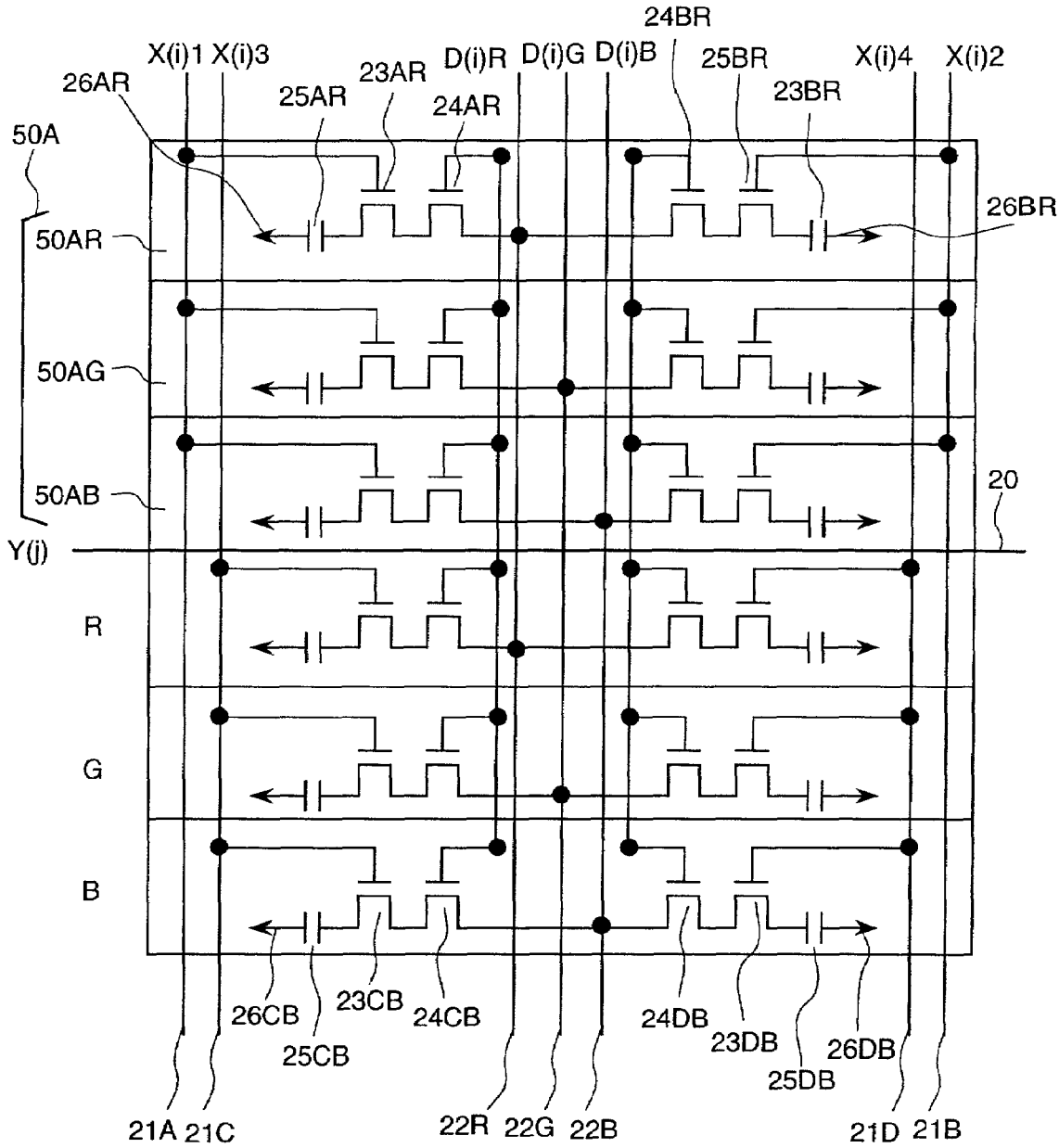
FIG. 12 is a schematic circuit diagram showing a ninth embodiment of a pixel structure pattern for realizing an image zone separation display according to the present invention.

FIG. 12 is a circuit diagram showing a ninth embodiment of a pixel structure pattern for realizing image zone separation display according to the present invention.

The ninth embodiment is provided with a pixel electrode and an opposed electrode on the same substrate and is a system for applying a lateral electric field to the liquid crystal layer. In the second embodiment, an arrangement of 2×2 pixels is taken as one block unit. A plurality of block units are arranged for forming the entire display area. The number of pixels forming one block unit is not limited to four, but can be of any number. However, in consideration of a lowering of the opening ratio due to an increase in the number of lines and so forth, it is preferred to form one pixel block with four pixels.

It should be noted that the image display apparatus employing the image zone separating display system of the present invention is not only applicable to a liquid crystal display, but is also applicable to an ELD, FED, PDP and so forth. Here, the present invention will be described in terms of a liquid crystal display as the most preferred example.

The ninth embodiment of the liquid crystal display device, which has a lighting device on a back surface and includes a pair of transparent substrates having a polarizing panel and a liquid crystal layer sandwiched between a pair of transparent substrates, controls the orienting condition of the liquid crystal layer by applying an electrical field to the liquid crystal layer for displaying an image.

In the ninth embodiment, one pixel consists of three pixel components consisting of a red pixel component 50AR, a green pixel component 50AG and a blue pixel component 50AB, and one block consists of four pixels 50A, 50B, 50C and 50D.

In the circuit construction of one pixel block constituted of four pixels, as shown in FIG. 12, concerning respective components, the upper left pixel is identified by designations A, the upper right pixel is identified by the designation B, the lower left pixel is identified by the designation C and the lower right pixel is identified by the designation D. Furthermore, the designations R, G, B are appended to respective ones of the red, green and blue pixels.

Scanning line 20 provided in common for four pixels is formed at the center to the scanning line 20, gates, such as twelve thin film transistors 24AR, 24BR, 24CB and 24DB, operating as a first switch, are connected.

To the gate electrodes of the thin film transistors 23AR, 23AG, 23AB, operating as a second switch, the block selection signal line 21A is connected. To the gate electrodes of the thin film transistors 23BR, 23BG, 23BB, operating as a second switch, the block selection signal line 21B is connected. To the gate electrodes of the thin film transistors 23CR, 23CG, 23CB, operating as a second switch, the block selection signal line 21C is connected. To the gate electrodes of the thin film transistors 23DR, 23DG, 23DB, operating as a second switch, the block selection signal line 21D is connected.

The source electrode of the thin film transistor, operating as the first switch, is connected to the drain electrode of the thin film transistor, operating as the second switch. To the source electrodes of the thin film transistors, operating as the second switch, electrodes of respective pixel components are connected. Across the liquid crystal layer, opposed electrodes 26AR, 26BR, 26CB, 26DB and so forth are connected for forming pixel components 25AR, 25BR, 25CB, 25DB and so forth.

Opposed electrodes 26AR, 26BR, 26CB, 26DB and so forth are provided as common electrodes for all pixels. In respective ones of the pixel components 25AR, 25BR, 25CB, 25DB and so forth, holding capacitors are formed in parallel.

When the pixel is constructed as set forth above, the image zone separation display discussed in connection with FIG. 2 can be realized.

In the embodiment illustrated in FIG. 12, the scanning line 20 is connected to the gate electrode of the first switch, and a block selection signal line is connected to the gate electrode of the second switch. However, in the alternative, it is possible to adopt a circuit construction in which the block signal selection lines per pixel are connected to respective gates and the scanning line 20 is connected to drain electrodes of all four pixels.

It should be noted that the driving voltage waveform applied to respective lines for image zone separation display is the same as that shown in FIG. 4 in connection with the first embodiment. Accordingly, when a still image is displayed in the high definition region and a dynamic image is displayed in the low definition region, the dynamic image and still image are displayed in an admixed manner, the dynamic image is rewritten at a high speed and the still image is displayed with a high definition.

Tenth Embodiment

Figure 13:
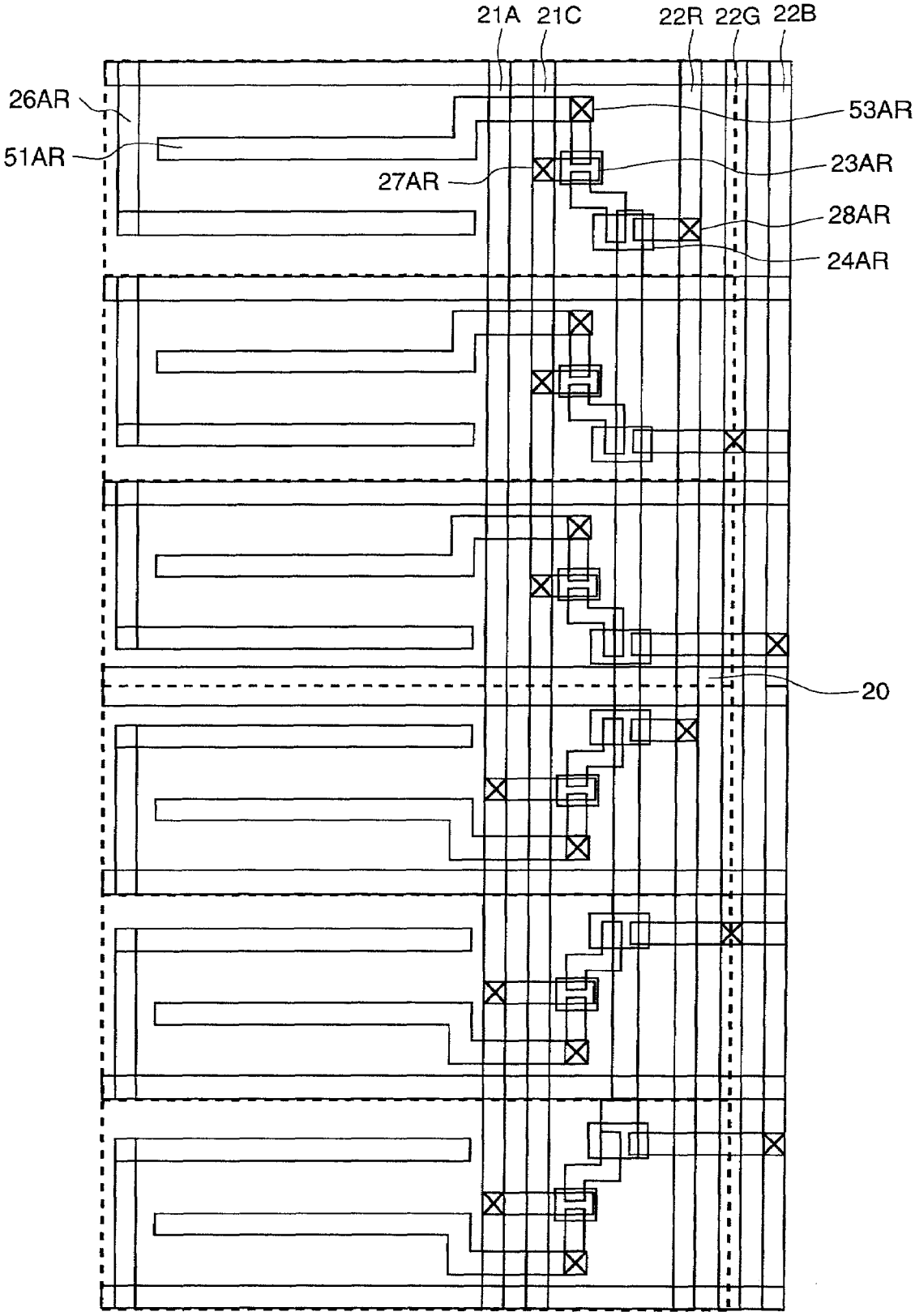
FIG. 13 is a plan view showing a tenth embodiment of a pixel structure pattern for realizing an image zone separation display according to the present invention.

FIG. 13 is a plan view showing a tenth embodiment of a pixel structure pattern for realizing image zone separation display according to the present invention.

The tenth embodiment is directed to a system for applying a lateral electric field to the liquid crystal layer, with the pixel electrode and the opposed electrode being provided on the same substrate in the ninth embodiment. The color filter has a stripe structure in parallel to the scanning line 20 to improve the opening ratio. However, the color filter may have a stripe structure arranged perpendicular to the scanning line 20.

On the other hand, in the eighth embodiment, while the electrodes at different layers are connected by contact portions 27, 28, 53 and so forth, the layer structure is not limited to the structure shown in the drawing.

Other operations and effects of the eighth embodiment are similar to the seventh embodiment.

Eleventh Embodiment

Figure 14:
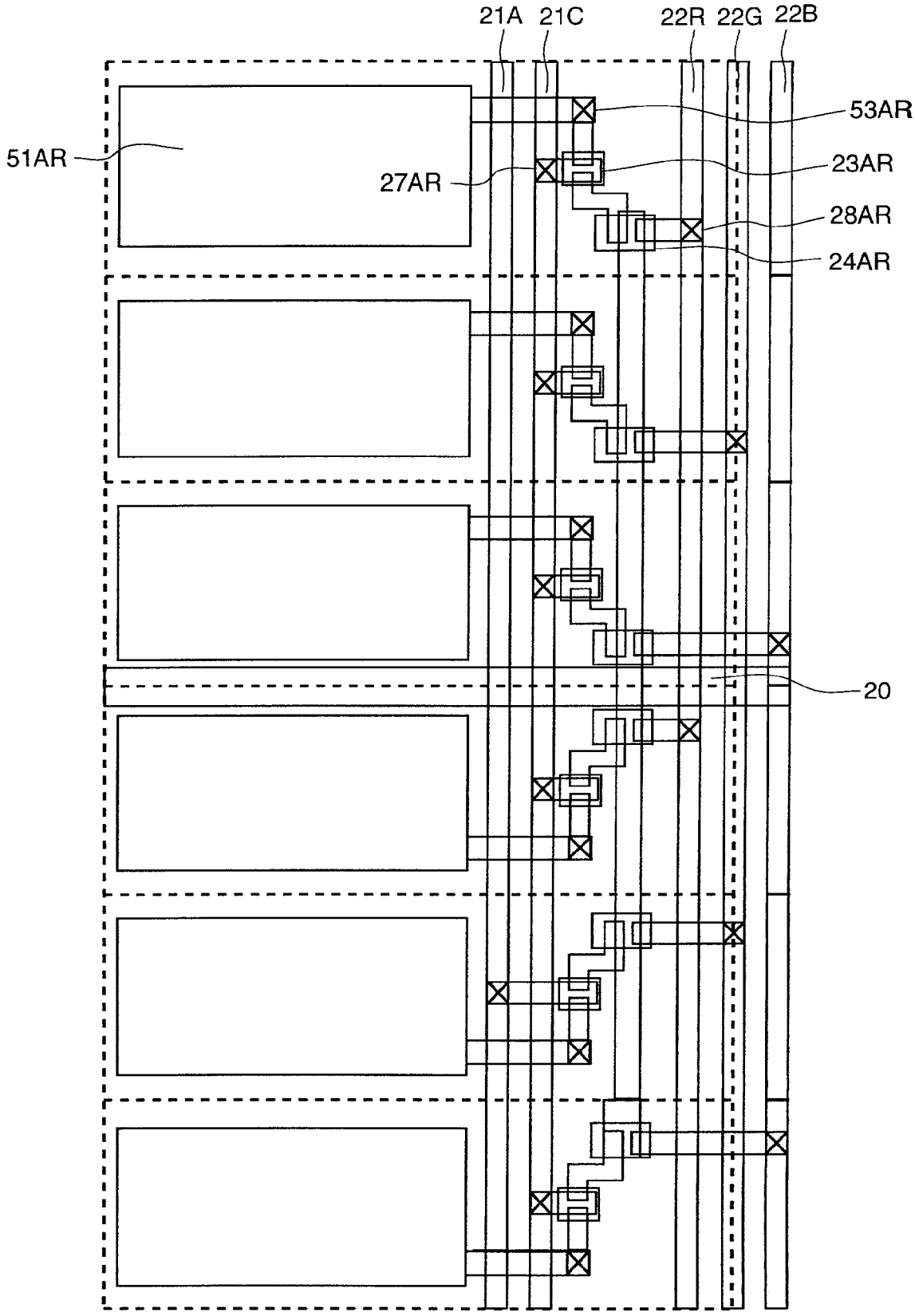
FIG. 14 is a plan view showing a eleventh embodiment of a pixel structure pattern for realizing an image zone separation display according to the present invention.

FIG. 14 is a plan view showing an eleventh embodiment of a pixel structure pattern for realizing image zone separation display according to the present invention.

The eleventh embodiment is directed to a system for applying a lateral electric field to the liquid crystal layer, with the pixel electrode and the opposed electrode being provided on the same substrate as used in the tenth embodiment. Other operations and effects are similar to the tenth embodiment.

Twelfth Embodiment

Figure 15:
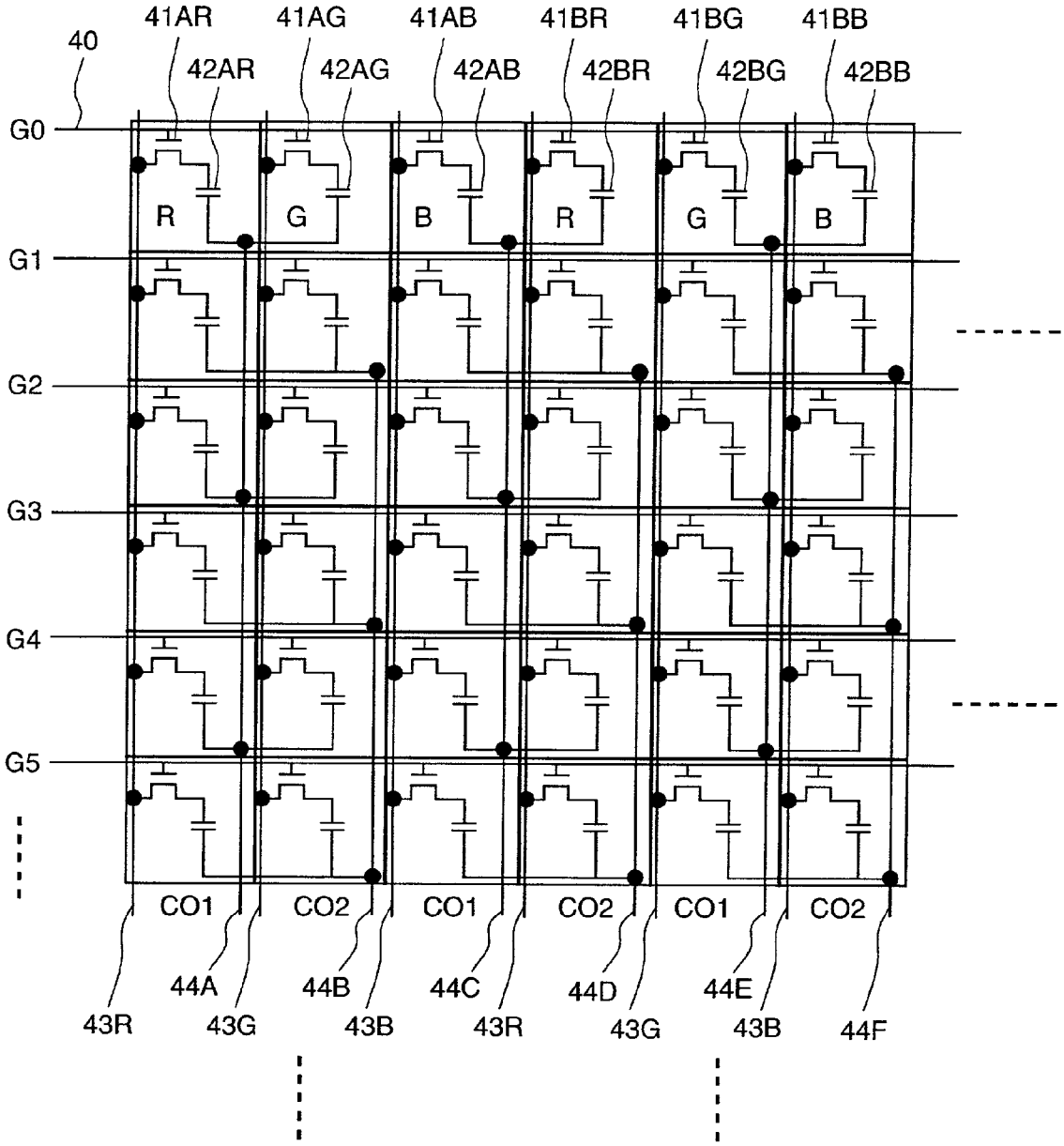
FIG. 15 is a circuit diagram showing a twelfth embodiment of a pixel structure pattern for realizing an image zone separation display according to the present invention.

FIG. 15 is a circuit diagram showing a twelfth embodiment of a pixel structure pattern for realizing image zone separation display according to the present invention.

The twelfth embodiment is directed to a pixel circuit construction in which an arrangement of 2 pixels×2 pixels is taken as one block. A plurality of such pixel circuit blocks are arranged for forming the overall display area of the display panel 15. It should be noted that one pixel block is not necessarily consisted of four pixels but can be any reasonable number. However, in consideration of a lowering of the opening ratio due to an increase in the number of lines and so forth, it is preferred to form one pixel block with four pixels.

It should be noted that the image display apparatus employing the image zone separating display system of the present invention is not only applicable to a liquid crystal display, but is also applicable to an ELD, FED, PDP and so forth. Here; the present invention will be described in terms of a liquid crystal display as the most preferred example.

The twelfth embodiment of the liquid crystal display device, which has a lighting device on a back surface and includes a pair of transparent substrates having a polarizing panel and a liquid crystal layer sandwiched between a pair of transparent substrates, controls the orienting condition of the liquid crystal layer by applying an electrical field to the liquid crystal layer for displaying an image.

In the twelfth embodiment, one pixel consists of three pixel components, and one pixel block consists of four pixels To the scanning line 40, the gate electrodes of the thin film transistors 41AR, 41AG, 41AB and so forth, operating as a switch, are connected per one pixel component. To the drain electrode of the thin film transistor 41, the red image signal line 43R, the green image signal line 43G and the blue image signal line 43B are connected, respectively.

To the source electrode of the thin film transistor 41, a pixel electrode is connected. The liquid crystal layer is sandwiched between the pixel electrode and the opposed electrode 44 to form a pixel component.

The opposed electrode 44 is provided in common for a pair of laterally adjacent pixel components. Furthermore, the opposed electrode 44 is used in common for one line. In the lateral direction of FIG. 15, the opposed electrodes 44A, 44B, 44C, 44D, 44E and 44F are supplied with a voltage at a respectively arbitrary timing.

By employing such a construction, in comparison with the first to eleventh embodiments, the pixel structure can be simplified so as to simplify the fabrication process and lower the cost.

In the embodiment shown in FIG. 15, the opposed electrode is provided in common for a pair of laterally adjacent pixel components. However, the opposed electrode can be provided in common for three pixel components of R, G and B. By providing the opposed electrode in common for three pixel components, the number of the opposed electrode lines 44 can be reduced to increase the opening ratio. Also, since one pixel normally consists of three pixel components of R, G, B, the opposed electrode can be controlled per pixel to reduce the driving and signal processing load.

Figure 16:
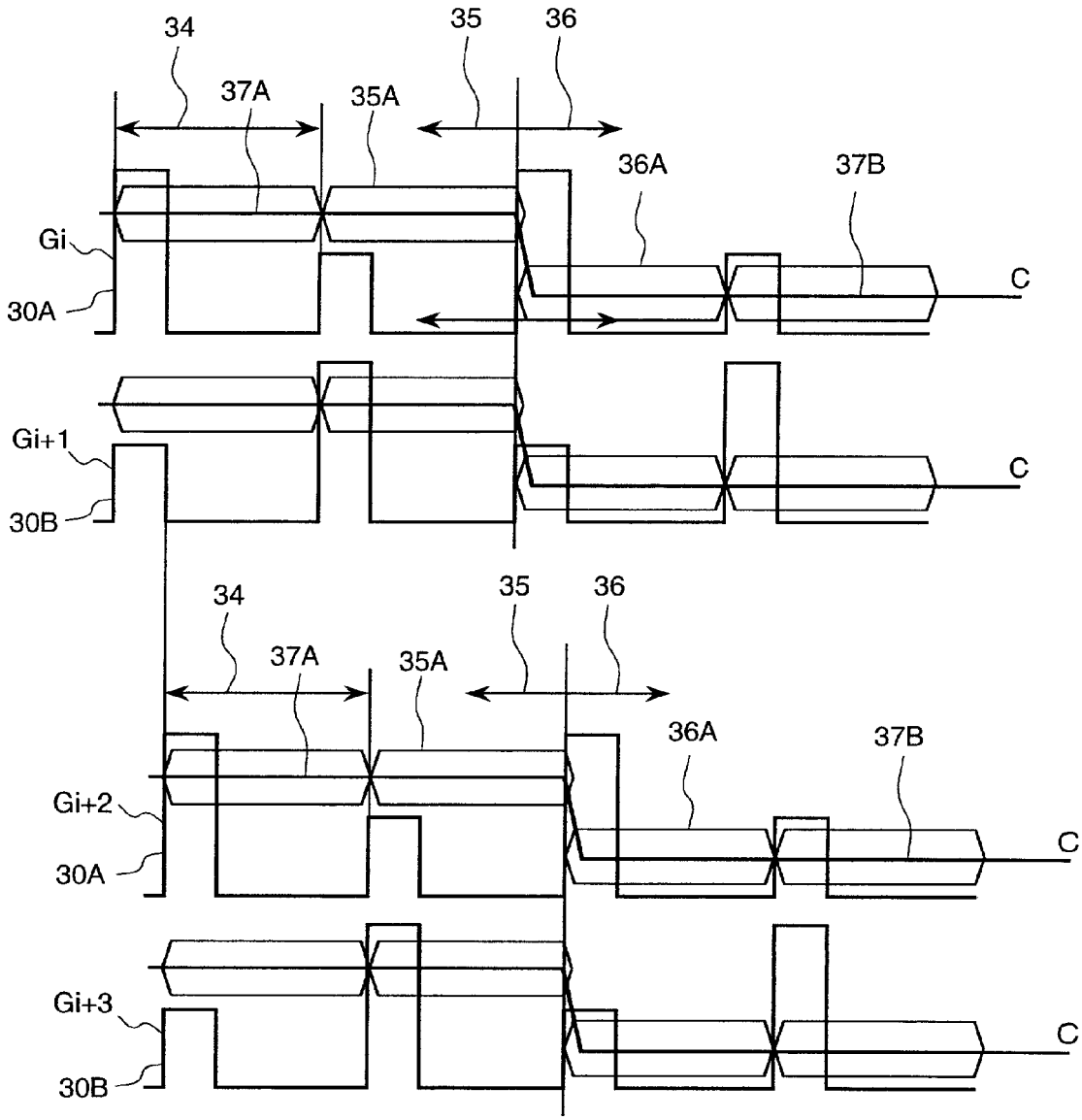
FIG. 16 is a timing chart showing one example of driving voltage waveforms to be applied to each line of the circuit of FIG. 15 for producing an image zone separation display according to the present invention.

FIG. 16 is a timing chart showing one example of a driving voltage waveform to be applied to each line of FIG. 15 for image zone separation display according to the present invention.

Consideration is given for Gi and Gi+1 of the (i)th and (i+1)th scanning lines. To the scanning line Gi, two levels of gate voltages 30 are applied per frame period 34. To the scanning line Gi+1, a voltage 30B, obtained by inverting two levels of the gate voltage applied to the scanning line Gi, is applied simultaneously.

Here, it is assumed that a region in a period 35 is a high definition display region and a region in a period 36 is a low definition display region. In the high definition display period 35, a potential 37A of the opposed electrode 44 is elevated so as to be high. At the same time, an image signal 35A is also elevated, simultaneously. The thin film transistor 41 is not turned ON at two low levels of the gate voltages 30A and 30B and the thin transistor 41 is turned ON only at two high potential levels of the gate voltages 30A and 30B, six pixel components are written and the remaining six pixels are held at the preceding voltage in twelve pixels formed of blocks of 2×2 pixels.

In the next frame, the voltage levels of Gi and Gi+1 of the scanning line 40 are inverted, data of the written pixel components in the preceding frame is held, and data held in the preceding frame is rewritten. On the other hand, in the low definition display period 36, the potential 37B at the opposed electrode 44 is made low. At this time, the image signal 36A is simultaneously made low so as to turn ON the thin film transistor 41 together with two levels of gate voltages 30A and 30B. An image is rewritten in all of the twelve pixel components formed of blocks of 2×2 pixels. Accordingly, in the high definition region, an image is formed with two frames and in the low definition region, high speed rewriting can be performed per frame.

Next, even on the scanning line Gi+2, Gi+3, similarly, the high definition display region and the low definition display region are discriminated. When the driving waveform is input, image zone separating display can be performed. Accordingly, when the still image is displayed on the high definition display region and the dynamic image is displayed on the low definition display region, the dynamic image is rewritten and the still image is displayed with a high definition.

Figure 17:
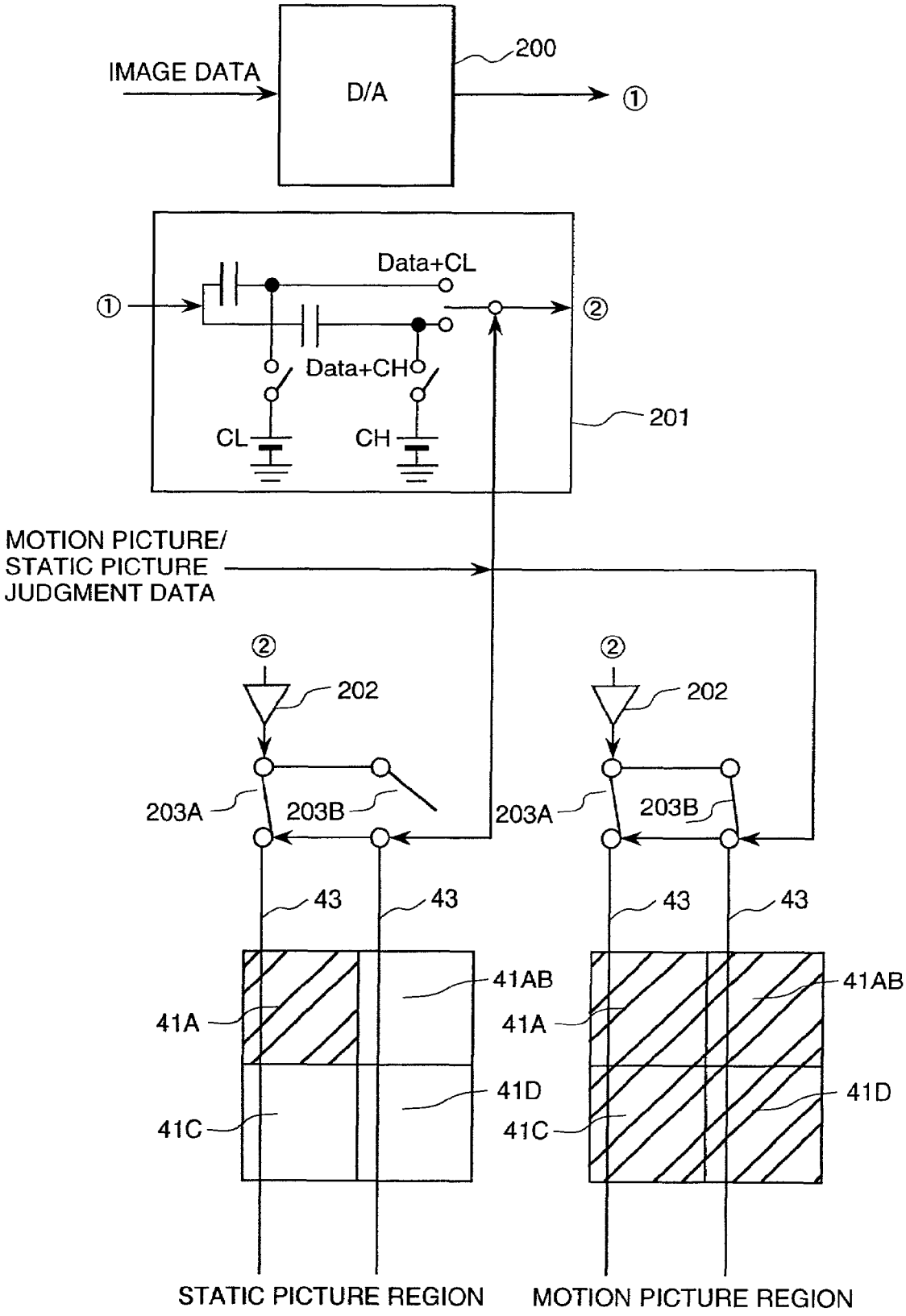
FIG. 17 is a schematic circuit diagram showing a circuit construction for level shifting voltages of image signals 35A and 36A in the twelfth embodiment.

FIG. 17 is a circuit diagram showing a circuit construction for level shifting voltages of image signals 35A and 36A in the twelfth embodiment. At first, the image data from the image signal generating device, such as personal computer or the like, is converted by a D/A converter 200. According to discrimination data of dynamic image and the still image, one of the high level signal 35A and the low level signal 36A is selected by a level shifter 201 to apply a signal to the signal line 43 through an amplifier 202.

At this time, when a still image of high definition is displayed, through the signal line 43, the high level signal 35A obtained by the level shifter 201 is applied to one pixel 41 in the pixel block. At the next frame, by writing in a different pixel while holding the currently written pixel component, a high definition display becomes possible.

In case of dynamic image display at low definition, through the signal line 43, low level signal 36A obtained by the level shifter 201 is applied to all pixel components in the pixel blocks.

In the twelfth embodiment, in the high definition region, one pixel component in one pixel block is selected and displayed. However, by arranging the level shifter 201 per signal line 43, pixel components 41A and 41D arranged diagonally are written simultaneously. Similarly, pixel components 41B and 41D are written simultaneously.

Upon low definition display, by arranging the level shifter 201 per signal line 43, the pixel components 41A and 41C are written by the same signal. Also, the pixel components 41B and 41D are written by the different same signal, simultaneously. Accordingly, in the twelfth embodiment, an arbitrary region is selected per scanning line 40, and multiple definition display becomes possible.

On the other hand, even with a simple pixel structure which is substantially the same as a conventional pixel structure, the image zone separation display system can be realized by only dividing the opposed electrode. Furthermore, the illustrated system can select an arbitrary region when the number of pixel components is greater than or equal to two, or an integral multiple of two pixel components in the direction of scanning line 40.

Thirteenth Embodiment

Figure 18:
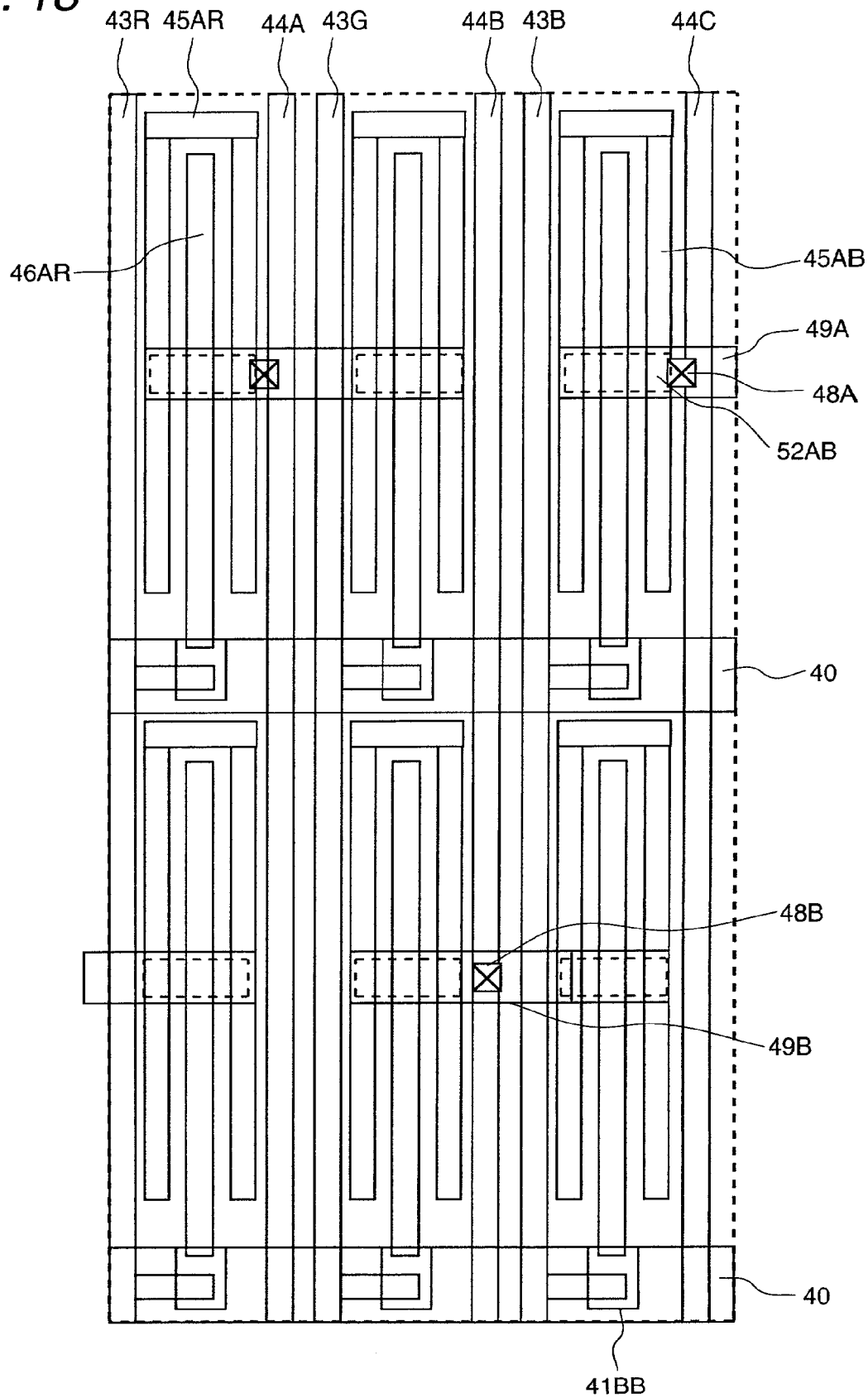
FIG. 18 is a plan view showing a thirteenth embodiment of a pixel structure pattern for realizing an image zone separation display according to the present invention.

FIG. 18 is a plan view showing a thirteenth embodiment of a pixel structure pattern for realizing image zone separation display according to the present invention.

The thirteenth embodiment is directed to a system for applying a lateral electric field to the liquid crystal layer, with the pixel electrode and the opposed electrode being provided on the same substrate as used in the twelfth embodiment. One pixel consists of three pixel components of red, green and blue, and one block consists of four pixels as a block of 2×2 pixels.

The gate electrodes of the thin film transistors 41AR, 41AG, 41AB and so forth, operating as a switch, per one pixel component are connected to the scanning line 40; and, to the drain electrode of the thin film transistor 41, the red color image signal line 43R, the green color image signal line 43G and the blue color image signal line 43B are connected, respectively. To the source electrode of the thin film transistor 41, the pixel electrode is connected. Between the pixel electrode and the opposed electrode 44, the liquid crystal layer is disposed.

The opposed electrode 44 is provided in common for two laterally adjacent pixel components. Furthermore, the opposed electrode 44 is provided in common for one line. The opposed electrode consists of the opposed electrodes 44A, 44B, 44C, . . . connected in the pixel via the contact portions 52.

Other effects and operations are similar to those in the twelfth embodiment.

Fourteenth Embodiment

Figure 19:
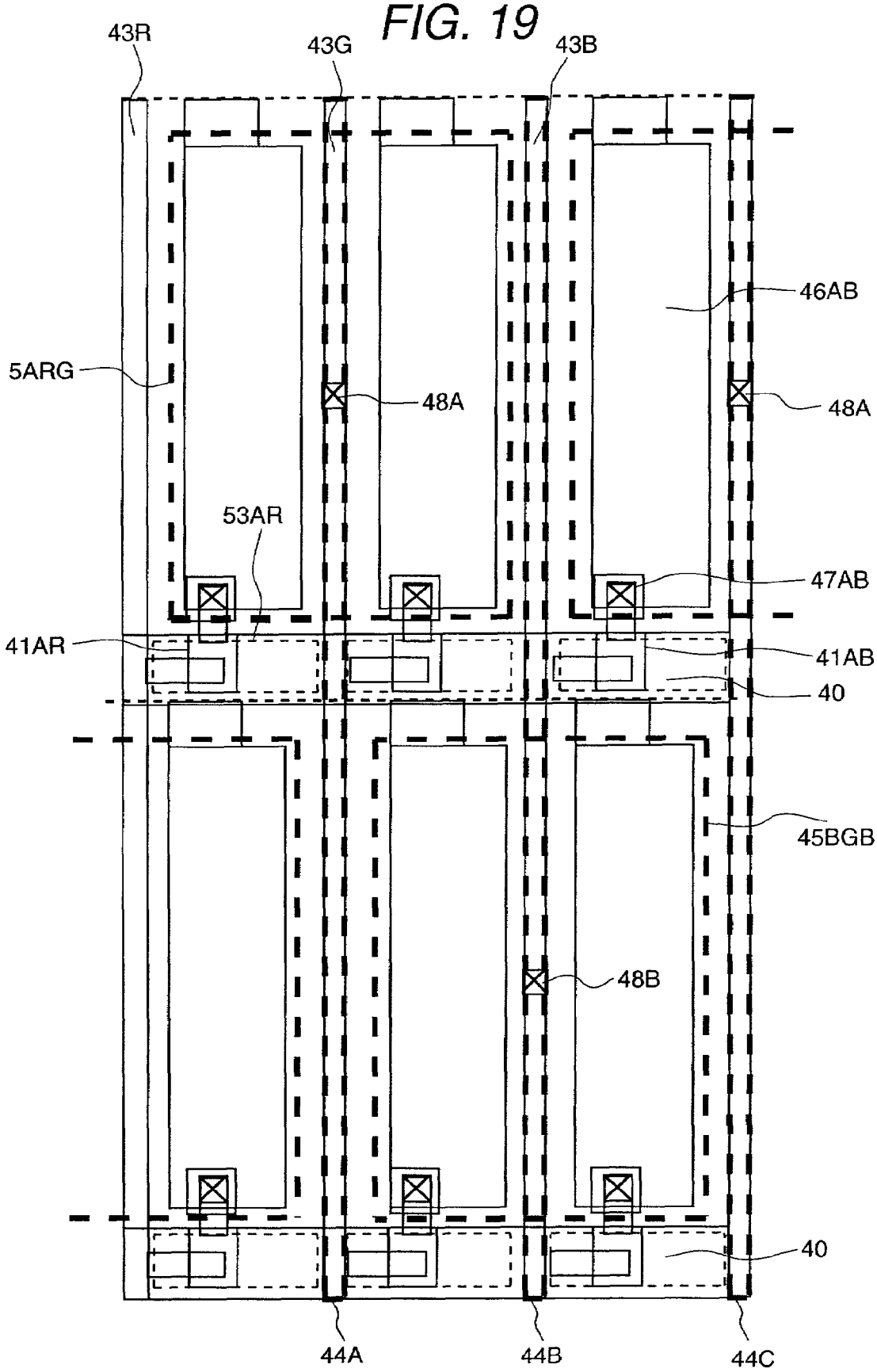
FIG. 19 is a plan view showing a fourteenth embodiment of a pixel structure pattern for realizing an image zone separation display according to the present invention.

FIG. 19 is a plan view showing a fourteenth embodiment of a pixel structure pattern for realizing image zone separation display according to the present invention.

The fourteenth embodiment is directed to a system for applying a lateral electric field to the liquid crystal layer, with the pixel electrode and the opposed electrode being provided on the same substrate as used in the thirteenth embodiment.

To the scanning line 40, the gate electrodes of the thin film transistors 41AR, 41AG, 41AB and so forth, operating as a switch, are connected per one pixel component. To the drain electrode of the thin film transistor 41, the red image signal line 43R, the green image signal line 43G and the blue image signal line 43B are connected, respectively. To the source electrode of the thin film transistor 41, a pixel electrode is connected. The liquid crystal layer is sandwiched between the pixel electrode and the opposed electrode 44 to form a pixel component.

The opposed electrode 44 is arranged on the side of the counter substrate and is arranged in common for two laterally adjacent pixel components. Furthermore, the opposed electrode 44 is provided in common for one line. The opposed electrode consists of the opposed electrodes 44A, 44B, 44C, . . . connected in the pixel via the contact portions 48. While the pixel electrode 45 has to be a transparent electrode, the opposed electrodes 44A and 44B may be formed of metal so as to significantly reduce the line resistance.

When the structure of the fourteenth embodiment is employed, the opening ratio can be increased significantly. Other effects and operations are similar to those of the thirteenth embodiment.

Fifteenth Embodiment

Figure 20:
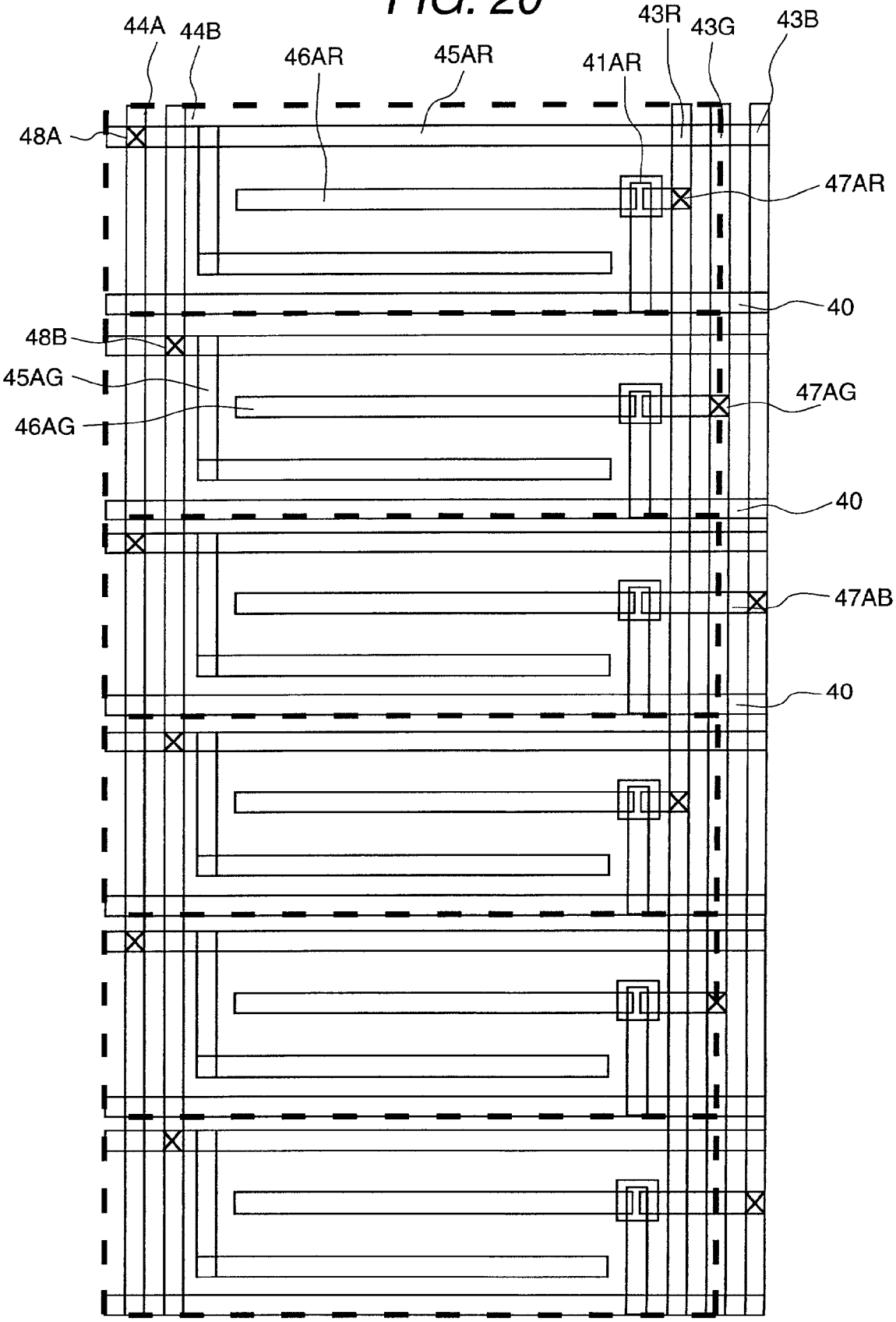
FIG. 20 is a plan view showing a fifteenth embodiment of a pixel structure pattern for realizing an image zone separation display according to the present invention.

FIG. 20 is a plan view showing the fifteenth embodiment of a pixel structure pattern for realizing image zone separation display according to the present invention.

The fifteenth embodiment is constructed by employing a stripe structure in parallel to the scanning line for the color filter of the thirteenth embodiment.

Other effects and operations are similar to those of the thirteenth-embodiment.

Sixteenth Embodiment

Figure 21:
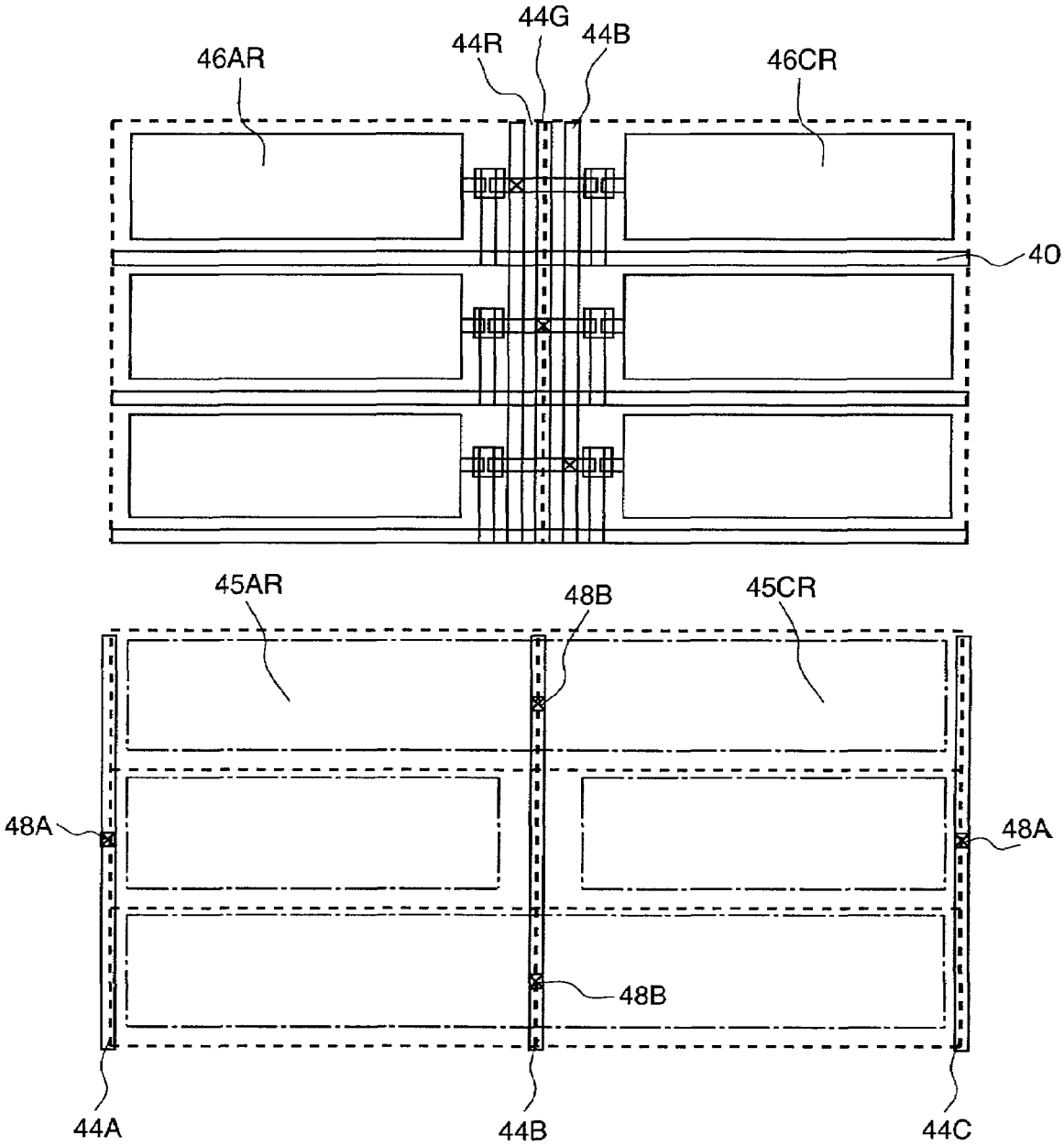
FIG. 21 is a plan view showing a sixteenth embodiment of a pixel structure pattern for realizing an image zone separation display according to the present invention.

FIG. 21 is a plan view showing the sixteenth embodiment of a pixel structure pattern for realizing image zone separation display according to the present invention.

The opposed electrode 45 on the counter substrate may be divided per two pixels, as shown in FIG. 21, and the divided portions are connected per one line via the contact line 48.

Other effects and operations are similar to those of the fourteenth embodiment.

Seventeenth Embodiment

Figure 22:
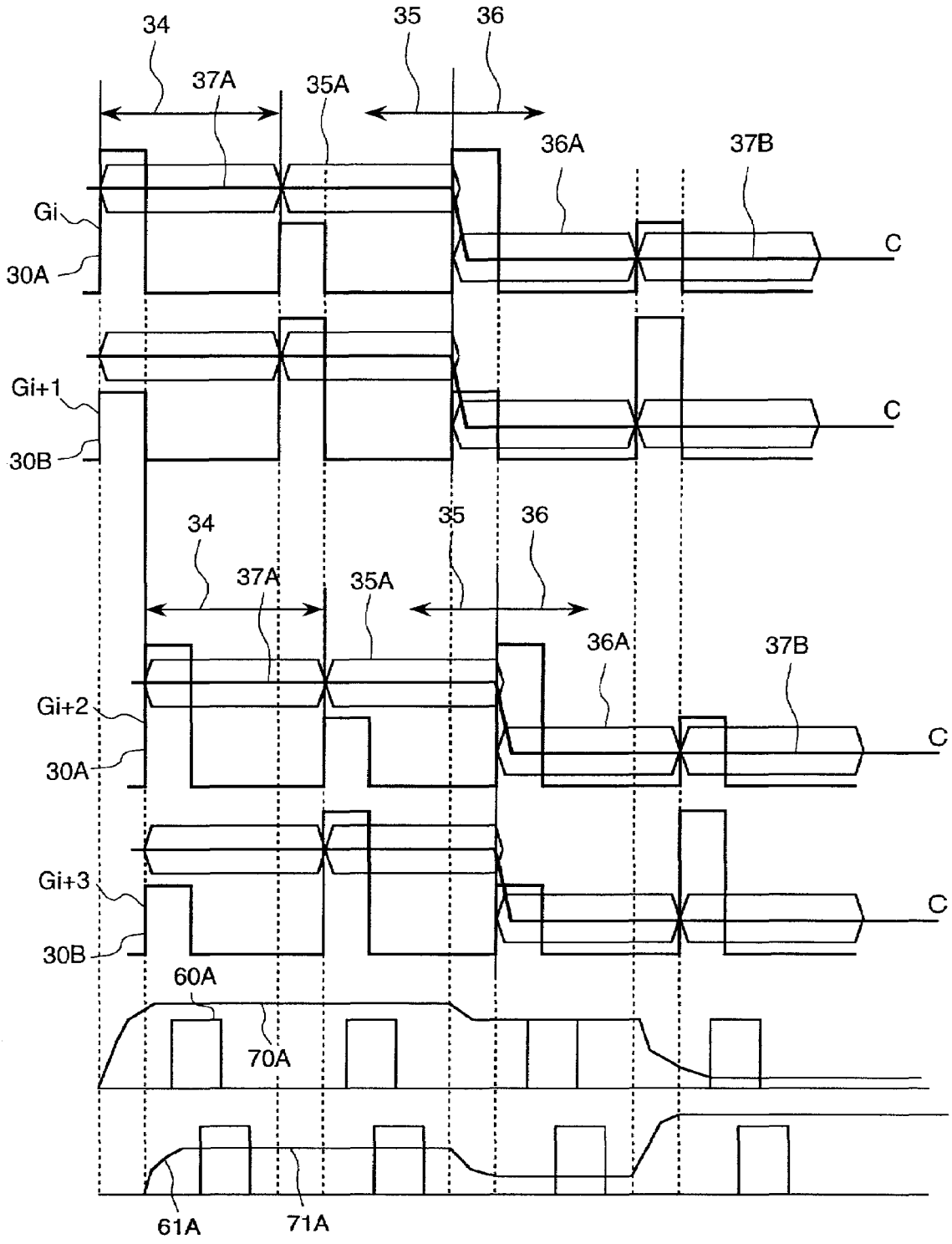
FIG. 22 is a timing chart showing operational waveforms of a seventeenth embodiment in which a blink back light is used for obtaining a clear dynamic image in the image zone separating display system according to the present invention.

FIG. 22 is a timing chart showing operational waveforms of the seventeenth embodiment in which a blink back light is employed for obtaining a clear dynamic image in the image zone separating display system according to the present invention. This feature is applicable to any embodiment having one switch per one pixel component.

The seventeenth embodiment of the liquid crystal display device, which has a lighting device on a back surface and includes a pair of transparent substrates having a polarizing panel and a liquid crystal layer sandwiched between a pair of transparent substrates, controls the orienting condition of the liquid crystal layer by applying an electrical field to the liquid crystal layer for displaying an image.

When a coefficient of transmission of the liquid crystal layer is varied, as shown by curves 70A and 70B, if the lighting device is illuminated, as shown by curves 60A and 61A, in synchronism with the response of the liquid crystal, a clear image can be obtained within a region rewritten at high speed and at low definition.

When illumination of the lighting device dividing the high definition region and the low definition region is difficult, in order to prevent fluctuation of the brightness in the high definition region and the brightness in the low definition region, the illumination of the lighting device has to be blinked in synchronism with the scanning line signals 30A and 30B.

Eighteenth Embodiment

Figure 23:
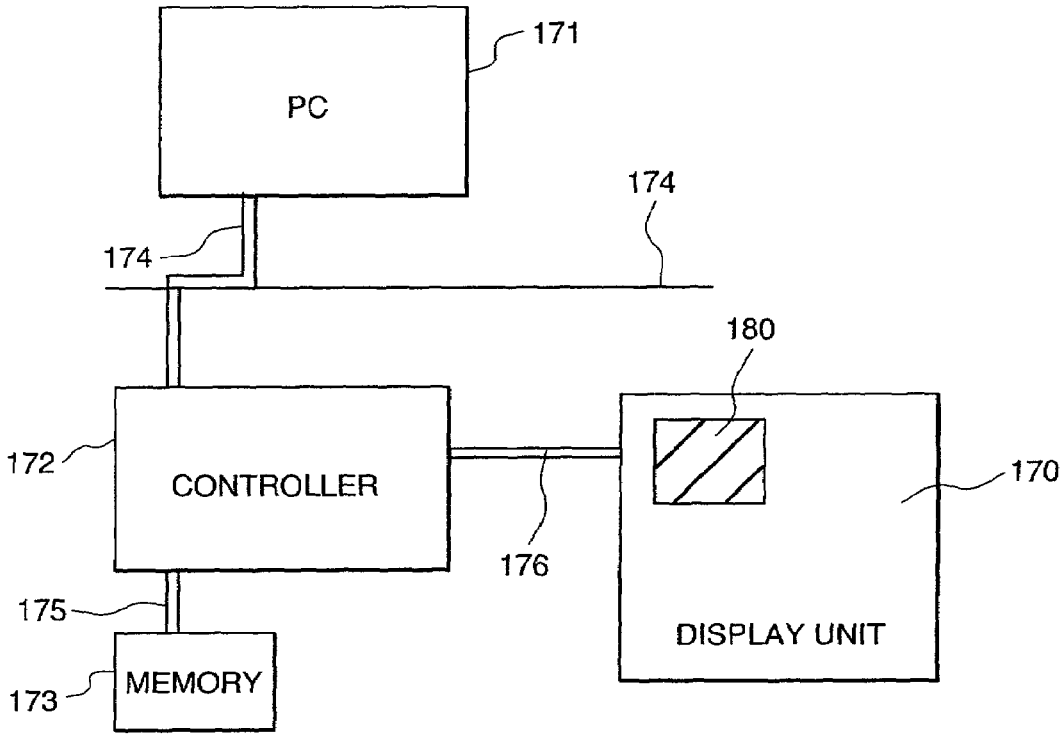
FIG. 23 is a block diagram showing an eighteenth embodiment of an image display system adapted for an image zone separating display system according to the present invention.

FIG. 23 is a block diagram showing an eighteenth embodiment of an image display system adapted for image zone separating display according to the present invention. The eighteenth embodiment includes a dynamic image/still image discrimination circuit 180 within the image display apparatus 170. The image signal from an image signal generating device 171, such as a personal computer or the like, is input to a display control device 172 operating as a graphic controller, and data for the entire screen is accumulated in a frame memory.

The dynamic image/still image discrimination circuit 180 discriminates whether the data from the display control device 172 is dynamic image data or still image data to be displayed on the image display apparatus.

With the eighteenth embodiment, by replacing the conventional image display device with the image display device 170, image zone separation substantially achieving both high definition image display and high speed dynamic image display is achieved. It should be noted that the illustrated embodiment of the image display apparatus can not only involve a replacement of the conventional image displaying apparatus, but also can be an arrangement in which the image display device 170 is used together with the conventional image displaying apparatus.

Nineteenth Embodiment

Figure 24:
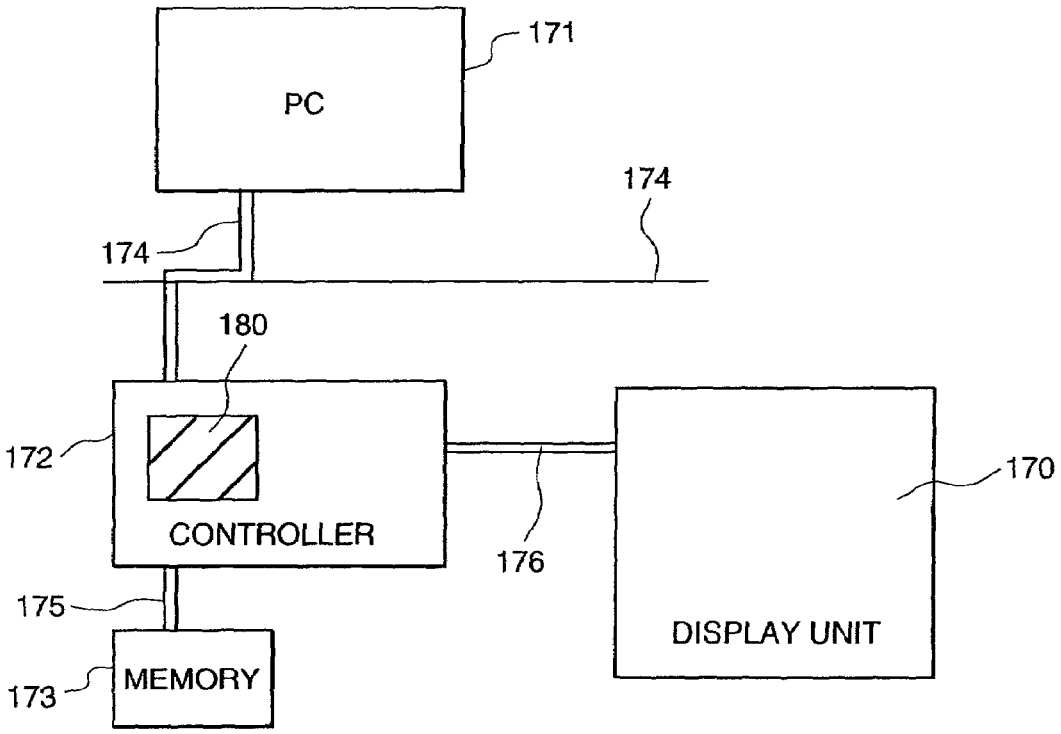
FIG. 24 is a block diagram showing a nineteenth embodiment of an image display system adapted for an image zone separating display system according to the present invention.

FIG. 24 is a block diagram showing a nineteenth embodiment of an image display system adapted for image zone separating display according to the present invention. The nineteenth embodiment includes a dynamic image/still image discrimination circuit 180 provided in the display control device 172 operating as a graphic controller. The image signal of a personal computer which forms the image signal generating device 171 is input to the display control device 172 via bus line 174. The input image signal is subject to discrimination between the dynamic image and the still image and is fed to the conventional image display apparatus 170 through the line 176.

With the nineteenth embodiment, the signal frequency on the line 176 can be reduced to permit high density information transfer. On the other hand, the data portion which does not vary from that of the preceding frame is transferred from the frame memory 173 and only the portion that is rewritten in the preceding frame is transferred from the graphic controller 172. Accordingly, the load on the transmission path downstream of the graphic controller 172 can be decreased to permit high density display.

Furthermore, since the dynamic image/still image discrimination circuit 180 is included, an increase in the size and weight of the image display apparatus 170 can be avoided to provide an image display apparatus which is compact.

Twentieth Embodiment

Figure 25:
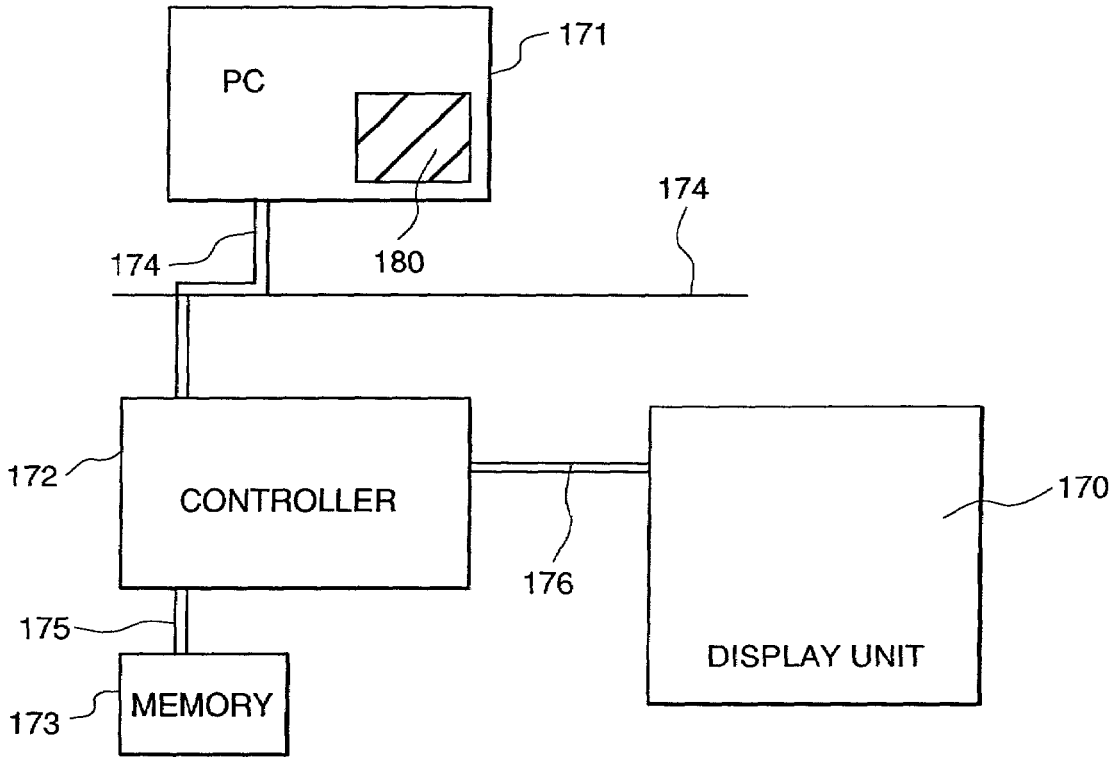
FIG. 25 is a block diagram showing a twentieth embodiment of an image display system adapted for an image zone separating display system according to the present invention.

FIG. 25 is a block diagram showing a twentieth embodiment of an image display system adapted for image zone separating display according to the present invention. The twentieth embodiment includes the dynamic image/still image discrimination circuit 180 in the image signal generating device 171, which may take the form of a personal computer. The dynamic image/still image discrimination circuit 180 discriminates whether the data supplied to the display control device 172 is dynamic image data or still image data to be displayed on the image display apparatus.

With the twentieth embodiment, the load of the paths 174, 175 and 176 can be reduced to permit high speed processing of high density information. Furthermore, since the dynamic image/still image discrimination circuit 180 is included, an increase in the size and weight of the image display apparatus 170 can be avoided so as to provide an image display apparatus that is compact.

With the present invention, utilizing human visual characteristics to eliminate information of low recognition level, it is possible to obtain an image display apparatus which can substantially achieve both high density still image display and high speed dynamic image display.

Namely, the image display apparatus which incorporates the image zone separation display system can arbitrarily switch the region for displaying high speed rewriting with lowering of the definition level of the dynamic image and the region for effecting high definition display of a still image at low speed in order to achieve both high density still image display and high speed dynamic image display.

As a result, an image display apparatus, which can perform high definition still image display, high speed dynamic image display, multiple gradation level display and large information amount for achieving satisfactory image quality, can be achieved.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not-be understood as limited to the specific embodiments set out above, but includes all possible embodiments which can fall within a scope encompassed and equivalent thereof with respect to the features set out in the appended claims.

What is claimed is:

1. An image display apparatus having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a region for displaying the same information on a plurality of pixels in one of said one block units during one scanning period and a region for permitting display of respectively different information on a plurality of pixels in an other one of said one block units;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of a matrix;

a plurality of first switches formed corresponding to intersections of said plurality of said scanning lines and a plurality of said first signal lines;

a plurality of second switches formed between a plurality of said second signal lines and a plurality of said first switches;

a pixel electrode connected to a plurality of said first switches or a plurality of said second switches;

an opposed electrode connected to a plurality of said first switches or a plurality of said second switches;

an electric field being applied between said pixel electrode and said opposed electrode; and an image being displayed by controlling an orienting condition of said liquid crystal;

wherein said lighting device has light emission control means for shifting a light emitting region in synchronism with the scanning signal applied to said scanning line.

2. An image display apparatus, a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a region for displaying the same information on a plurality of pixels in one of said one block units during one scanning period and a region for permitting display of respectively different information on a plurality of pixels in an other one of said one block units;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of a matrix;

a plurality of first switches formed corresponding to intersections of said plurality of said scanning lines and a plurality of said first signal lines;

a plurality of second switches formed between a plurality of said second signal lines and a plurality of said first switches;

a pixel electrode being connected to a plurality of said second switches;

an opposed electrode on one of said pair of transparent substrates;

an electric field being applied between said pixel electrode and said opposed electrode; and an image being displayed by controlling an orienting condition of said liquid crystal;

wherein said lighting device has light emission control means for shifting a light emitting region in synchronism with the scanning signal applied to said scanning line.

3. An image display apparatus, having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a region for displaying the same information on a plurality of pixels in one of said one block units during one scanning period and a region for permitting display of respectively different information on a plurality of pixels in an other one of said one block units;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of matrix;

a plurality of switches formed corresponding to intersections of said plurality of said scanning lines and a plurality of said first signal lines;

said pixel electrode being connected to a plurality of said switches;

an opposed electrode formed on one of said pair of transparent substrates and divided per a plurality of pixels;

an electric field being applied between said pixel electrode and said opposed electrode; and an image being displayed by controlling an orienting condition of said liquid crystal;

wherein said lighting device has lighting control means for moving a light emitting region in synchronism with a scanning signal applied to said scanning line.

4. An image display apparatus having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a region for displaying the same information on a plurality of pixels in one of said one block units during one scanning period and a region for permitting display of respectively different information on a plurality of pixels in an other one of said one block units;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of matrix;

a plurality of switches formed corresponding to intersections of said plurality of said scanning lines and a plurality of said first signal lines;

said pixel electrode being connected to a plurality of said switches;

an opposed electrode formed on one of said pair of transparent substrates and divided per a plurality of pixels;

an electric field being applied between said pixel electrode and said opposed electrode; and an image being displayed by controlling an orienting condition of said liquid crystal;

wherein a selection signal level to be applied to said scanning line controlling condition of said switch and a selection signal level to be applied to said opposed electrode are selection signal levels having at least two values; and wherein a level shifter is provided for varying level of an image data signal to be applied to said signal line adapting to the selection signal level of said opposed electrode.

5. An image displaying apparatus as set forth in claim 4, wherein one block unit is formed with predetermined number of pixels, said scanning line selection signal level and said opposed electrode signal level for the same display on a plurality of pixels in said one block unit in one scanning period and said scanning line selection signal level and said opposed electrode signal level for selecting arbitrary pixel in said one block unit, and switching means is provided for switching the region for the same display on a plurality of pixels in said one block unit in one scanning period and the region permitting different display on a plurality of pixels in one block unit for a plurality times of scan.

6. An image display apparatus as set forth in claim 4, wherein said lighting device has lighting control means for moving a light emitting region in synchronism with a scanning signal applied to said scanning line.

7. An image display apparatus having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a dynamic image region for displaying the same information on a plurality of pixels in one of said one block units during one scanning period and a still image region for permitting display of respectively different information on a plurality of pixels in an other of said one block units;

wherein said dynamic image region is displayed on the basis of dynamic image data from said dynamic image/still image discriminating circuit; and wherein said still image region is displayed on the basis of still image data from said frame memory;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of a matrix;

a plurality of first switches formed corresponding to intersections of said plurality of said scanning lines and a plurality of said first signal lines;

a plurality of second switches formed between a plurality of said second signal lines and a plurality of said first switches;

a pixel electrode connected to a plurality of said first switches or a plurality of said second switches;

an opposed electrode connected to a plurality of said first switches or a plurality of said second switches;

an electric field being applied between said pixel electrode and said opposed electrode; and an image being displayed by controlling an orienting condition of said liquid crystal;

wherein said lighting device has light emission control means for shifting a light emitting region in synchronism with the scanning signal applied to said scanning line.

8. An image display apparatus having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a dynamic image region for displaying the same information on a plurality of pixels in one of said one block units during one scanning period and a still image region for permitting display of respectively different information on a plurality of pixels in an other of said one block units;

wherein said dynamic image region is displayed on the basis of dynamic image data from said dynamic image/still image discriminating circuit; and said still image region is displayed on the basis of still image data from said frame memory;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of a matrix;

a plurality of first switches formed corresponding to intersections of said plurality of said scanning lines and a plurality of said first signal lines;

a plurality of second switches formed between a plurality of said second signal lines and a plurality of said first switches;

a pixel electrode being connected to a plurality of said second switches;

an opposed electrode on one of said pair of transparent substrates;

an electric field being applied between said pixel electrode and said opposed electrode; and an image being displayed by controlling an orienting condition of said liquid crystal;

wherein said lighting device has light emission control means for shifting a light emitting region in synchronism with the scanning signal applied to said scanning line.

9. An image display apparatus having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a dynamic image region for displaying the same information on a plurality of pixels in one of said one block units during one scanning period and a still image region for permitting display of respectively different information on a plurality of pixels in an other of said one block units;

wherein said dynamic image region is displayed on the basis of dynamic image data from said dynamic image/still image discriminating circuit; and wherein said still image region is displayed on the basis of still image data from said frame memory;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of matrix;

a plurality of switches formed corresponding to intersections of said plurality of said scanning lines and a plurality of said first signal lines;

said pixel electrode being connected to a plurality of said switches;

an opposed electrode formed on one of said pair of transparent substrates and divided per a plurality of pixels;

an electric field being applied between said pixel electrode and said opposed electrode; and an image being displayed by controlling an orienting condition of said liquid crystal;

wherein said lighting device has lighting control means for moving a light emitting region in synchronism with a scanning signal applied to said scanning line.

10. An image display apparatus having a display controller for converting an image data into a display data, an image converting circuit and a display panel, comprising:

a frame memory feeding data having different resolution on said display panel and a dynamic image/still image discriminating circuit;

said display panel including a signal driver applying an image data signal to at least one signal line, a control signal driver applying a scanning signal to at least one scanning line and a pixel selection driver for applying a display block selection signal to at least one selection signal line;

said display panel taking a predetermined number of pixels among a plurality of pixels having a pixel electrode arranged in matrix fashion as one block unit, and one screen image of a plurality of one block units for displaying is formed by combining a dynamic image region for displaying the same information on a plurality of pixels in one of said one block units during one scanning period and a still image region for permitting display of respectively different information on a plurality of pixels in an other of said one block units;

wherein said dynamic image region is displayed on the basis of dynamic image data from said dynamic image/still image discriminating circuit; and wherein said still image region is displayed on the basis of still image data from said frame memory;

a lighting device provided on a back surface;

a pair of transparent substrates having a polarizing panel;

a liquid crystal layer disposed between said pair of transparent substrates;

one of said pair of transparent substrates having a plurality of said scanning lines;

first signal lines and second signal lines formed with a plurality of said scanning lines in a form of matrix;

a plurality of switches formed corresponding to intersections of said plurality of said scanning lines and a plurality of said first signal lines;

said pixel electrode being connected to a plurality of said switches;

an opposed electrode formed on one of said pair of transparent substrates and divided per a plurality of pixels;

an electric field being applied between said pixel electrode and said opposed electrode; and an image being displayed by controlling an orienting condition of said liquid crystal;

wherein a selection signal level to be applied to said scanning line controlling condition of said switch and a selection signal level to be applied to said opposed electrode are selection signal levels having at least two values; and wherein a level shifter is provided for varying level of an image data signal to be applied to said signal line adapting to the selection signal level of said opposed electrode.

11. An image displaying apparatus as set forth in claim 10, wherein one block unit is formed with predetermined number of pixels, said scanning line selection signal level and said opposed electrode signal level for the same display on a plurality of pixels in said one block unit in one scanning period and said scanning line selection signal level and said opposed electrode signal level for selecting arbitrary pixel in said one block unit, and switching means is provided for switching the region for the same display on a plurality of pixels in said one block unit in one scanning period and the region permitting different display on a plurality of pixels in one block unit for a plurality times of scan.

12. An image display apparatus as set forth in claim 10, wherein said lighting device has lighting control means for moving a light emitting region in synchronism with a scanning signal applied to said scanning line.

* * * * *